US007036339B1

(12) United States Patent
Chia et al.

(10) Patent No.: US 7,036,339 B1
(45) Date of Patent: May 2, 2006

(54) JEWELRY ITEM

(76) Inventors: Meang K. Chia, 412 W. 6th St., Suite 1104, Los Angeles, CA (US) 90014; Cheo K. Chia, 412 W. 6th St., Suite 1104, Los Angeles, CA (US) 90014; Huy K. Chia, 412 W. 6th St., Suite 1104, Los Angeles, CA (US) 90014

( * ) Notice: Subject to any disclaimer, the term of this patent is extended or adjusted under 35 U.S.C. 154(b) by 0 days.

(21) Appl. No.: 10/070,037

(22) PCT Filed: Jun. 30, 2000

(86) PCT No.: PCT/US00/18389

§ 371 (c)(1),
(2), (4) Date: Feb. 26, 2002

(87) PCT Pub. No.: WO01/13754

PCT Pub. Date: Mar. 1, 2001

Related U.S. Application Data

(63) Continuation-in-part of application No. 09/383,814, filed on Aug. 26, 1999, now Pat. No. 6,532,766, and a continuation-in-part of application No. 09/224,936, filed on Dec. 31, 1998, now abandoned, and a continuation-in-part of application No. 29/120,104, filed on Mar. 10, 2000, now Pat. No. Des. 453,122, and a continuation-in-part of application No. 29/116,859, filed on Jan. 11, 2000, now Pat. No. Des. 448,318, and a continuation-in-part of application No. 29/110,327, filed on Sep. 3, 1999, now Pat. No. Des. 471,129, and a continuation-in-part of application No. 29/098,058, filed on Dec. 21, 1998, now Pat. No. Des. 418,445.

(51) Int. Cl.
*A44C 17/02* (2006.01)
*A44C 13/00* (2006.01)

(52) U.S. Cl. ..... 63/26; 63/28; 63/1.11; 63/1.16; 63/18; 29/10

(58) Field of Classification Search ..... 63/1.11, 63/1.16, 12, 13, 29.1, 18, 19, 26, 28; 29/10
See application file for complete search history.

(56) References Cited

U.S. PATENT DOCUMENTS

D12,579 S 11/1881 Reynolds (Continued)

FOREIGN PATENT DOCUMENTS

CN 238894 8/1945

(Continued)

OTHER PUBLICATIONS

*A& A Jewelry Tools & Findings*; Smooth edge coin, w/4 prong w/bail; 7 pages including G92.

*Primary Examiner*—Katherine Mitchell
(74) *Attorney, Agent, or Firm*—Ladas & Parry LLP

(57) ABSTRACT

A decorative jewelry item comprises a base member (2) with a hollow interior and a decorative top (7), a cap (19) brought down over the decorative top, and a fastener arrangement (21) for fixing the cap to the base member after the cap is brought into contact with the decorative top. The cap has an opening (23, 25) therein through which the decorative top (7, 9) of the base member can be observed. All exposed surfaces of the base member (2) and cap (19) may have surface finishing features and/or graphic representations or designs to make the jewelry item more attractive. In an alternative construction, a decorative insert is inserted, through an opening in the top of a hollow base member, and is fixed within the base member with the insert below the base member top and viewable through the top opening. The jewelry item may be designed to have the appearance of a single decorative unit, or to have the appearance of a double (or greater) decorative unit. Such units have application in many jewelry items. A number of such units may be connected in series to form a tennis bracelet.

2 Claims, 16 Drawing Sheets

U.S. PATENT DOCUMENTS

D14,818 S 2/1884 Merril
439,139 A 10/1890 Gaynor
569,495 A 10/1896 Gunther
572,237 A 12/1896 Adams
D32,439 S 4/1900 Gay
D32,649 S 5/1900 McCutchen et al.
795,109 A 7/1905 Dover
813,084 A 2/1906 Dover
851,078 A 4/1907 Dunn
901,333 A * 10/1908 Fitzgerald ..... 63/29.1
1,001,583 A 8/1911 Fairbrother
1,024,048 A 4/1912 Abel
D42,514 S 5/1912 Meyers
D42,643 S 6/1912 Meyers
1,153,362 A 9/1915 Wacha
D48,950 S 4/1916 Rosenberger
1,189,497 A 7/1916 Schwartzman
1,344,365 A 6/1920 Wachenheimer
D55,597 S 7/1920 Felger
D56,605 S 11/1920 Grasmuk
D56,607 S 11/1920 Grasmuk
1,410,366 A 3/1922 Buchman
1,433,521 A 10/1922 Albanese
1,443,654 A 1/1923 Schmidt
1,467,468 A 9/1923 Blanchard
1,556,465 A 10/1925 Wendel
1,570,776 A 1/1926 Peters
1,570,932 A 1/1926 Anderson et al.
1,589,423 A 6/1926 Payton
D70,779 S 8/1926 Speidel
D76,664 S 10/1928 Chase
D77,434 S 1/1929 Rice
1,701,610 A 2/1929 Forstner
1,710,660 A 4/1929 Guyot
D84,213 S 5/1931 Speidel
1,842,427 A 1/1932 Sammartino
1,854,958 A 4/1932 Santosuosso
1,892,738 A 1/1933 Schnarr
1,981,696 A 11/1934 Harper
D110,568 S 7/1938 Garfinkel
D117,577 S 11/1939 Sand
D119,286 S 3/1940 Somers
2,273,227 A 2/1942 Simmons
D131,750 S 3/1942 Hobe
D131,847 S 3/1942 Hobe
D143,583 S 1/1946 Feingold
D143,588 S 1/1946 Grun
D143,750 S 2/1946 Philippe
D144,901 S 6/1946 Braunstein
D145,426 S 8/1946 Braunstein
D146,779 S 5/1947 Slater
D151,904 S 11/1948 Katz
D155,873 S 11/1949 Chernow
D156,650 S 12/1949 Pearce et al.
D156,744 S 1/1950 Kent
D159,528 S 8/1950 Philippe
D159,582 S 8/1950 Boucher
D160,241 S 9/1950 Bardach
2,526,134 A 10/1950 Henry
2,538,090 A 1/1951 Ferragamo
D165,468 S 12/1951 Katz
2,584,207 A 2/1952 Holl
2,634,593 A 4/1953 Moretti
D176,664 S 1/1956 Katz
2,775,093 A 12/1956 Kundert
2,852,923 A 9/1958 Gamelsky
D184,930 S 4/1959 Gonicberg
D186,903 S 12/1959 Hess
3,025,820 A 3/1962 Rosenthal
D202,723 S 11/1965 Gaston
3,483,716 A 12/1969 Stenzler
D217,880 S 6/1970 Cowan
3,626,718 A * 12/1971 Schneider ..... 63/29.1
3,670,524 A 6/1972 Korwin
3,913,184 A * 10/1975 Hanan ..... 24/704.1
4,052,773 A * 10/1977 Nesbitt ..... 24/163 K
4,154,282 A 5/1979 Kull
4,165,574 A 8/1979 Sciotti
D257,017 S 9/1980 Barr
4,294,084 A * 10/1981 Lampert ..... 63/15
D265,639 S 8/1982 Barr
D266,954 S 11/1982 Gordan
4,399,910 A 8/1983 Gutentag
4,488,415 A 12/1984 Jenkins
D277,466 S 2/1985 Chien
4,551,993 A 11/1985 Nagahori
4,566,294 A 1/1986 Brzozowski
4,763,489 A 8/1988 Strong
4,781,038 A 11/1988 Branca et al.
D314,528 S 2/1991 Chia et al. ..... D11/93
D314,730 S 2/1991 Chia et al. ..... D11/93
D314,929 S 2/1991 Chia et al. ..... D11/6
D317,139 S 5/1991 Chia et al. ..... D11/93
D317,423 S 6/1991 Chia et al. ..... D11/93
D319,033 S 8/1991 Chia et al. ..... D11/93
5,048,311 A * 9/1991 Mastrobuono ..... 63/12
5,056,337 A 10/1991 Nhaissi
D322,043 S 12/1991 Chia et al. ..... D11/93
D325,180 S 4/1992 Chia et al. ..... D11/93
D325,709 S 4/1992 Chia et al. ..... D11/93
D325,710 S 4/1992 Chia et al. ..... D11/93
D325,711 S 4/1992 Chia et al. ..... D11/93
D325,886 S 5/1992 Chia et al. ..... D11/93
D329,026 S 9/1992 Chia et al. ..... D11/12
D329,206 S 9/1992 Chia et al. ..... D11/93
D329,401 S 9/1992 Chia et al. ..... D11/93
D331,726 S 12/1992 Chia et al. ..... D11/93
D335,639 S 5/1993 Chia et al. ..... D11/93
D336,057 S 6/1993 Chia et al. ..... D11/93
D336,059 S 6/1993 Chia et al. ..... D11/93
D336,060 S 6/1993 Chia et al. ..... D11/93
D337,069 S 7/1993 Chia et al. ..... D11/93
D337,070 S 7/1993 Chia et al. ..... D11/93
D337,283 S 7/1993 Keshishian
D337,546 S 7/1993 Keshishian
D337,547 S 7/1993 Keshishian
D338,852 S 8/1993 Keshishian
5,235,824 A * 8/1993 Huang ..... 63/20
5,289,700 A * 3/1994 Cheng ..... 63/12
5,337,584 A * 8/1994 Angeli ..... 63/1.17
5,355,698 A 10/1994 Edmark
5,365,754 A * 11/1994 Nalbandian ..... 63/26
5,454,234 A * 10/1995 Karmeli ..... 63/28
D379,074 S 5/1997 Udko
5,651,274 A * 7/1997 Taylor ..... 63/18
D388,016 S 12/1997 Kejejian
5,694,791 A 12/1997 Esposito
5,806,345 A 9/1998 Bonchek
D406,247 S 3/1999 Chia et al. ..... D11/93
5,950,287 A * 9/1999 Cacciatore et al. ..... 27/1
5,992,177 A 11/1999 Beard
D418,445 S 1/2000 Chia et al. ..... D11/93
D418,446 S 1/2000 Chia et al. ..... D11/93
D423,981 S 5/2000 Chia et al. ..... D11/93
6,116,054 A 9/2000 Czupor
D448,318 S 9/2001 Chia et al. ..... D11/93
6,532,766 B1 * 3/2003 Chia et al. ..... 63/26

FOREIGN PATENT DOCUMENTS

EP 0 063 751 A1 11/1982
FR 608150 7/1926
FR 709603 8/1931
FR 1 319 354 A 5/1963

| | | | |
|---|---|---|---|
| GB | 1 077 460 | | 7/1967 |
| GB | 1 200 257 | | 7/1970 |
| GB | 2 070 344 | A | 9/1981 |
| GB | 2 077 441 | A | 12/1981 |
| WO | 00/38551 | A1 | 7/2000 |

OTHER PUBLICATIONS

*All Karats International*; Edizioni, Primavera-Estate/Spring-Summer, Sixth Edition; "Diamond Necklace"; 2 pages including cover (1998).
California Gold Center; Bezel-set jewelry; 1 page.
Caroline Ballou Collection; 18k Tribal Interpretations; and Barnett Robinson, Inc.; 18k yellow gold and platinum rings (1 page).
"Charms" catalog by Americas GOLD; Item #136-20; p. 136.
Corona; Corona's Lasting Treasures Collection; Item SS 424.
Crafford Precision Products Co.; "Laser Spot-Welding Systems"; 4 pages; (1997).
*Fancy Catalog*, Item Nos. 11111, 11112, 11114, p. 111 (total 14 pages).
Gervais, J.; "A Little Light Welding", *AJM*, 4 pages (May 1998).
Hans D. Krieger; "JCK Show" catalog insert.
Hans D. Krieger; "Platinum Classic"; A Promotional Supplement to *Jewelers' Circular Keystone*, p. 178 (May 1997).
Jaha Jewelry Inc.; 6 pages total including J6, J10, J13.
Janet Alix necklace, *Jewelers' Circular Keystone*, p. 132 (May 1997).
"Liberty Collections" by Liberty I. Exchange; pp. 4 and 21 (Item 6ML-588 6.1gr).
"Love Tears Collection" by Studs, Inc., *Jewelers' Circular Keystone*; diamond solitaire necklaces in 18k gold; (Dec. 1997).
Maty, Collection Automne—Hiver 97-98, Valeur 30F, No. 76; 1 page.
Mervyn's California catalog flyer; #14; Cache fashion watch; p. 11 (1998).
*National Jeweler*; Items #P10529, #84622, (May 16, 1997).
P.Q.C. Jewelry; *National Jeweler*; Item N362, p. 142 (Jun. 1, 1998).
"Rio Grande: Gems & Findings"; Gold earrings: 14K yellow back-set French wire earrings Die Struck, Item "M", cover page and p. 90.
*Robinson's May*, Earring, Item No. 290131409, Purchased Apr. 18, 1999, 3 pages.
S&R Designs, Inc.; 18k Diamond Flower necklace, earrings, and bar bracelet; Styles Europa, 18k 2-one gold ring, bracelet, necklace with diamonds; 1 page.
Superior Diamond Cutters Inc.; *Jewelers' Circular Keystone*; Platinum and 18k gold slide pendant with diamonds; p. 108 (Dec. 1997).
*The Gold Book*, Oro America, Items HE.142(A) 2.37gr. (89), HE.141 (A) 2.37gr. (89), HE.143 (A) 2.89gr. (108), p. 18 (1996).
*The Multi-Color Gold Jewelry Book*, Oro America, Earring Items: ETR. 014 .95(39); ETR.022 1.0(42); ETLB.0011.7 (71); p. 1.
The Vatican Library Collection, *Jewelers' Circumlar Keystone*; Skalet gold; Item 4D and 4I, 1 page.
Uni-Creation Inc. , Emby International Inc. Collection.; 1 page.
Variety Gem Co. , Inc. ; *JCK Catalog*05-97; Items N5526, N5520A, N5520B; one page (May 1997).
Wards, Gold Hoop (Earring) with Diamond Cut Ovals, Item #459312000; Purchased Dec. 2000, 4 pages.

* cited by examiner

Fig. 1
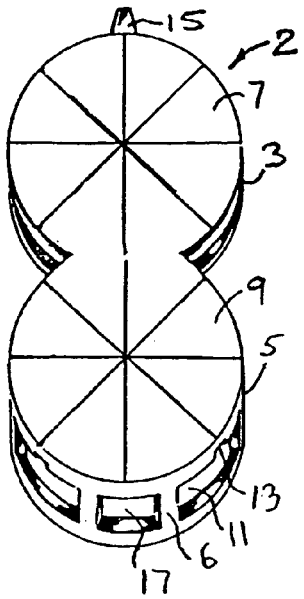
Fig. 4
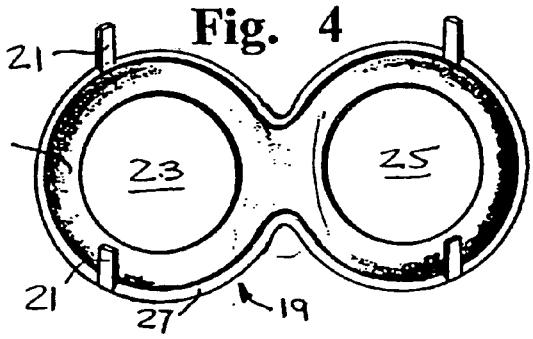
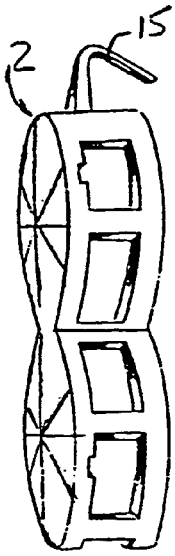
Fig. 3
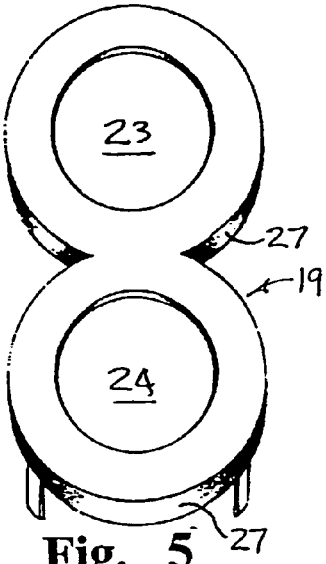
Fig. 5
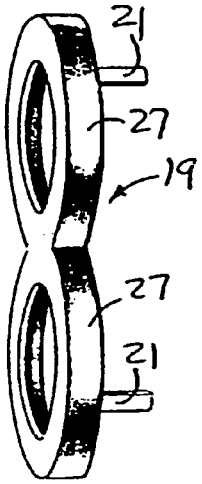
Fig. 6
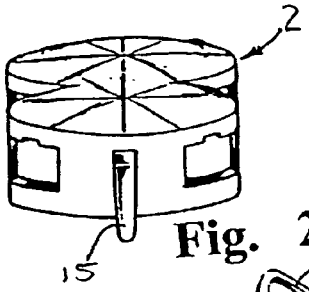
Fig. 2
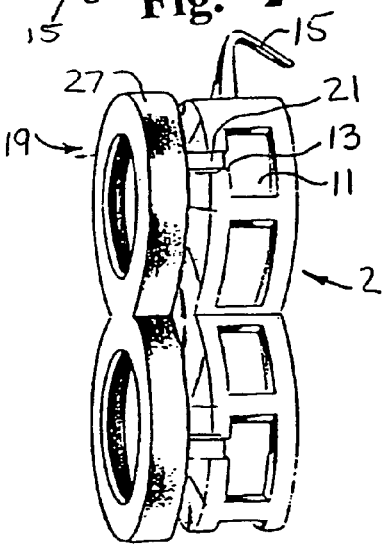
Fig. 7
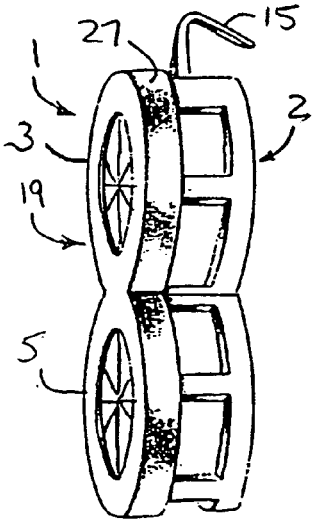
Fig. 8
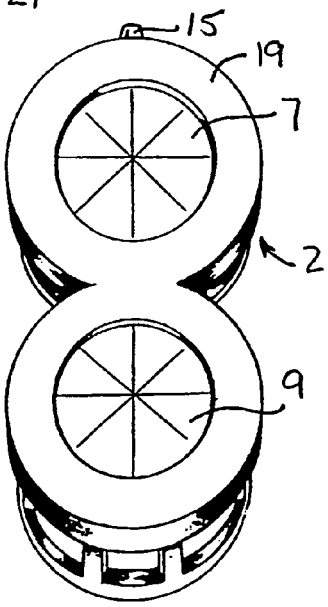
Fig. 9

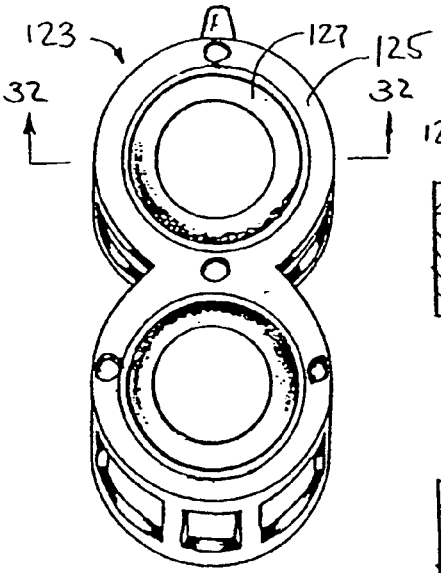
Fig. 31
Fig. 32
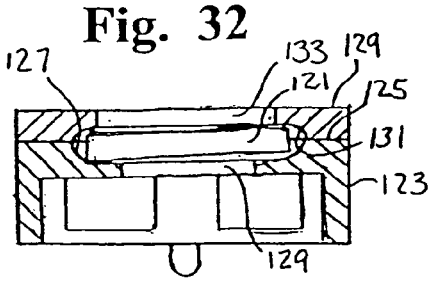
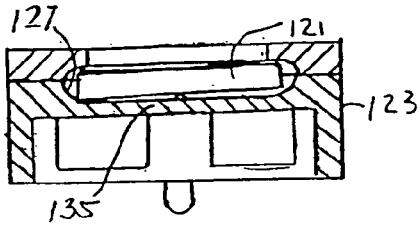
Fig. 33
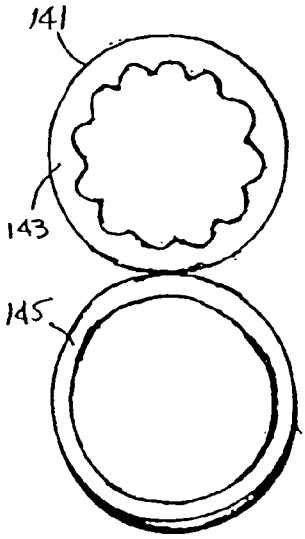
Fig. 34
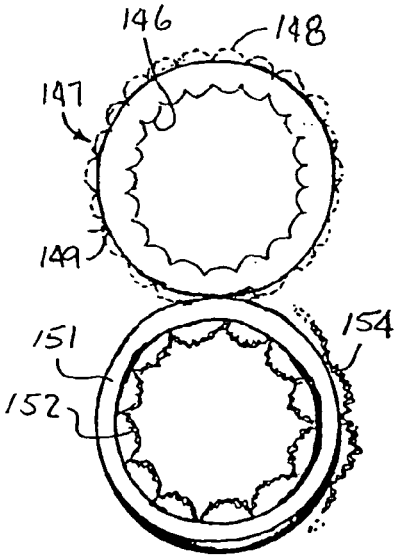
Fig. 35
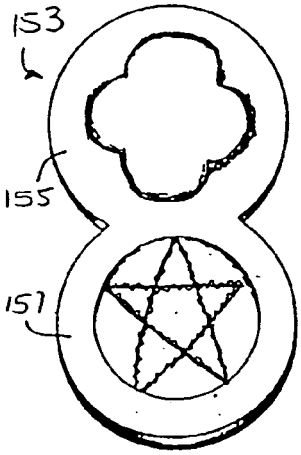
Fig. 36
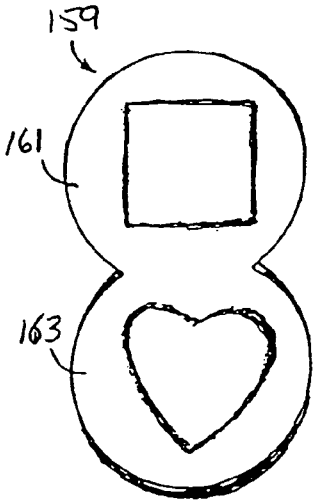
Fig. 37

FIG. 60
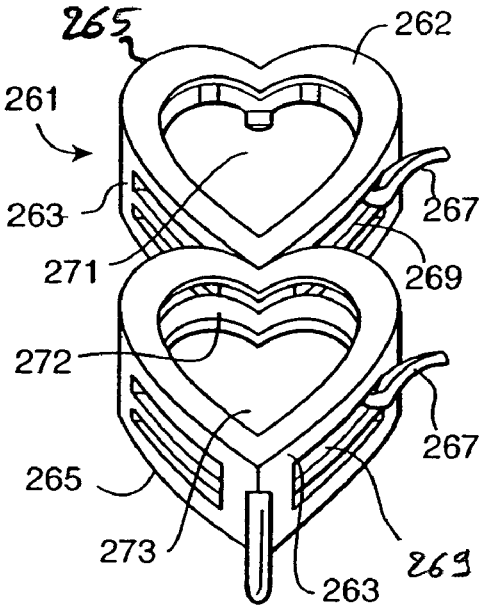
FIG. 61
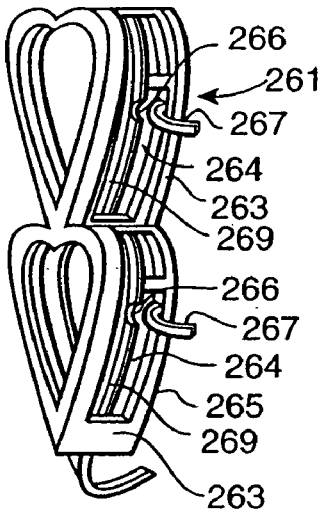
FIG. 62
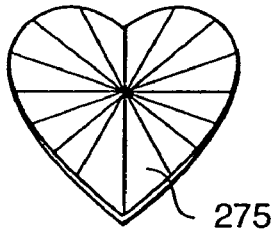
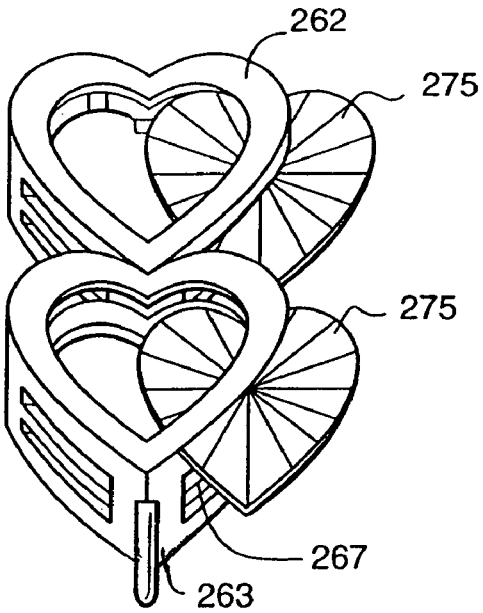
FIG. 63
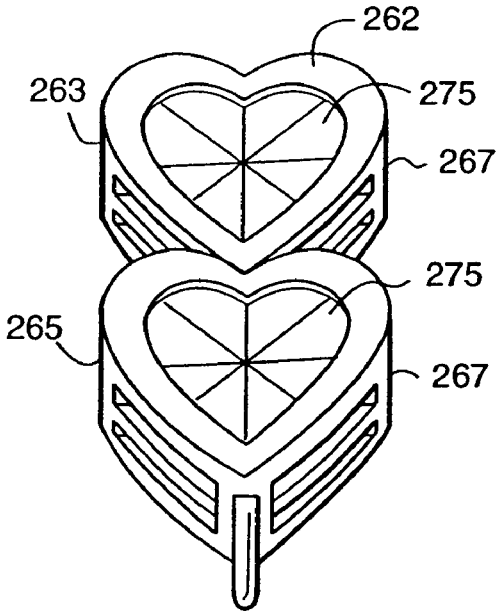
FIG. 64

JEWELRY ITEM

This is a continuation-in-part application of: (1) U.S. patent application Ser. No. 09/383,814 (filed 26 Aug. 1999), now U.S. Pat. No. 6,532,766; (2) U.S. patent application Ser. No. 09/224,936 (filed 31 Dec. 1998), now abandoned; (3) U.S. Design Patent Application No. 29/120,104 (filed 10 Mar. 2000), now U.S. Design Pat. No. D453,122; (4) U.S. Design Patent Application No. 29/116,859 (filed 11 Jan. 2000), now U.S. Design Pat. No. D448,318; (5) U.S. Design Patent Application No. 29/110,327 (filed 3 Sep. 1999), now U.S. Design Pat. No. D471,129; and (6) U.S. Design Patent Application No. 29/098,058 (filed 21 Dec. 1998), now U.S. Design Pat. No. D418,445. All of the applications mentioned in the preceding sentence are incorporated herein by this reference.

BACKGROUND OF THE INVENTION

1. Field of the Invention

This invention relates to items of jewelry, and in particular to a modular simulated gem and gem setting jewelry arrangement.

2. Brief Description of the Art

Unitary jewelry items and/or modular links for forming jewelry bracelets, necklaces, pendants, and rings are well known. The so-called tennis bracelet, for example, is a bracelet having a series of connected modular units, each unit comprising an actual diamond or other gem and a setting therefor.

Reference is made to the following U.S. patents:

Des. Pat. No. 110,568; L. Garfinkel
U.S. Pat. No. 1,189,497; A. Schwartzman
U.S. Pat. No. 1,589,423; H. Payton
U.S. Pat. No. 1,344,365; H. Wachenheimer
U.S. Pat. No. 2,538,090; H. Ferragamo
U.S. Pat. No. 4,781,038; Branca et al.
Des. Pat. No. 146,779; M. Slater
Des. Pat. No. 117,577; J. Sand
Des. Pat. No. 257,017; J. Barr
Des. Pat. No. 156,650; W. W. Pearce et al.
U.S. Pat. No. 4,763,489; L. Strong
Des. Pat. No. 48,950; C. Rosenberger
U.S. Pat. No. 1,410,366; E. H. Buchman
Des. Pat. No. 131,847; W. W. Hobe
U.S. Pat. No. 1,153,362; J. C. Wacha
Des. Pat. No. 42,643; H. H. Meyers
Des. Pat. No. 176,664; Adolph Katz
Des. Pat. No. 143,588; O. Green
Des. Pat. No. 265,639; Josef J. Barr
Des. Pat. No. 84,213; A. E. R. Speidel
Des. Pat. No. 56,605; H. Grasmuk
Des. Pat. No. 151,904; A. Katz
Des. Pat. No. 145,426; J. Braunstein
Des. Pat. No. 144,901; J. Braunstein
Des. Pat. No. 160,241; P. Bardach Reference is also made to prior U.S. patent applications of the inventor of the present invention as follows: patent application Ser. No. 07/572,678, filed Aug. 23, 1990 for "BRACELET DESIGN", which is a continuation application of Design Application Serial No. 397,094 filed Aug. 22, 1989 entitled "BRACELET OR THE LIKE"; and patent application Ser. No. 09/224,936 filed Dec. 31, 1998 entitled "DECORATIVE JEWELRY ITEM". All of the applications mentioned in this paragraph are incorporated herein by this reference.

Non-patent references of interest may include:

1. "Charms" catalog, Page 136, Item #136-20, by Americas GOLD, 650 South Hill St., Los Angeles, Calif. 90014'
2. "Liberty Collections" catalog, Pages 4 and 21, by Liberty I. Exchange, 333 Washington St. #203-1, Boston, Mass. 02108;
3. "Diamond Flower" jewelry by S&R Designs, Inc., Marlton, N.J.;
4. Items #P10529, #84619, #84622, National Jeweler, May 16, 1997;
5. Janet Alix necklace, Jewelers' Circular Keystone, May, 1997;
6. Catalog Item #4D, Skalet Gold, 3600 N. Talman Ave., Chicago, Ill. 60618;
7. Caroline Ballou Collection, June Las Vegas Show, K25–K27, and Barnett Robinson, Inc. June Las Vegas Show, Galleria #10;
8. Item N362, P.Q.C. Jewelry, National Jeweler, Jun. 1, 1998, Page 142;
9. "Love Tears" collection, by Studs, Inc., 42 W. 48 St., New York, N.Y. 10036;
10. Slide pendant, by Superior Diamond Cutters Inc., 589 Fifth Ave., New York, N.Y. 10017;
11. Uni-Creation, Inc., Emby International, Inc. collection, 589 Fifth Avenue, New York, N.Y. 10017;
12. A Promotional Supplement To JCK, May 1997, Pages 178, 179;
13. Item SS424, Corona Jewellery Company, 16 Ripley Ave., Toronto, Ontario, M6S 3N9, Canada;
14. "Bezel-set jewelry, California Gold Center, 606 S. Hill St., Los Angeles, Calif. 90014;
15. "Partners" fashion jewelry, Cache fashion watches, Mervyn's California catalog flyer, 1998, Page 11;
16. California Precision Products Co. Catalog "Laser Spot-Welding Systems", One Industrial Court, Riverside, R.I. 02915;
17. Maty, Collection Automne Hiver 97–98, Valeur 30F, No. 76.

The jewelry items shown and described in the art noted above take on various aesthetically pleasing forms for displaying gems, real or simulated, in a variety of visual and structural configurations.

Channel settings and bezel settings that use real gems increase the price of a jewelry item dramatically.

In all such items of the prior art in which a gem or simulated gem is mounted in a gem setting, the gem or simulated gem is positioned brought down from above the setting and secured in place. In assembling the gem and gem setting combination, typically a series of upwardly directed prongs project from the setting, also referred to as a "base", and the gemstone, or simulated gemstone, is lowered to fit within the upwardly extending prongs, after which the series of prongs are bent inwardly and downwardly to embrace the gem or simulated gem. While this configuration displays the gem in the foreground relative to the setting, there are many disadvantages to such construction.

In particular, with the prongs of the setting exposed, it is relatively easy to snag clothing or inflict minor injuries to the skin of a person by an inadvertent scraping action. Moreover, the prongs of the setting base are unsightly, detracting from the aesthetic qualities of the item of jewelry.

If one were to conceive of the idea of avoiding the unsightliness of upwardly extending gem mounting prongs, the idea would be quickly rejected, due to the fact that if a precious stone, for example a diamond or ruby, is mounted below the upper surface of the setting base, the pointed bottom of the stone would penetrate the skin of the user even more so than is commonly done even with stones mounted from the top of a setting base or bezel. The pointed bottom of a precious stone is, by design, formed with specific depth and angles to capture as much light as possible for reflection through the stone, thereby enhancing the brilliance and spectacle of the gem.

Yet another disadvantage of the use of prior art unitary modules for connection in series to form a tennis bracelet, for example, is that such bracelet construction is rather labor intensive, each modular unit having to be connected to an adjacent unit, and for a bracelet with, typically thirty or more, individual modules, the cost of the bracelet to the ultimate consumer may be inflated beyond expectation of the purchaser who values the item of jewelry on the basis of its precious stone content. Typical prong, channel, and bezel settings not only use expensive gems that sometimes get damaged during the setting procedure, but these types of settings themselves are costly. The purchaser would be greatly benefitted by a less costly manufacturing process, since, for the same purchase price, the purchaser would receive more or larger stones, simulated or real. Such simulated or real stones of a greater quality. There is therefore a need in the art for reducing the manufacturing costs of multi-modular jewelry items.

One solution to avoid employing upwardly extending gem mounting prongs is found in the aforementioned U.S. patent application Ser. No. 09/224,936 in which a gem or simulated gem is inserted from below into a hollow base member having a top bezel with and opening therein to expose the gem or simulated gem below.

SUMMARY OF THE INVENTION

The present invention satisfies the needs and desires of the purchasing public while simultaneously solving the aforementioned problems associated with jewelry items in which the gem is mounted above the setting using upwardly protruding prongs. The invention thus solves the same problems as does the aforementioned '936 patent application, but in a different way, while offering certain additional features not found in the '936 application.

In accordance with one aspect of the present invention, there is provided a decorative jewelry item, comprising: a hollow base member having a decorative top; a cap with an opening therein; and a cap attachment arrangement for attaching the cap to the hollow base member with at least a portion of the decorative top being viewable through the cap opening.

The decorative top may be integral with the base member, or it may be defined by a top surface on the base member with a separate decorative object fixed to such top surface.

In accordance with another aspect of the present invention, there is provided a decorative jewelry item, comprising: a base member having a hollow interior, a top with an opening therein leading to the hollow interior, a bottom, and a sidewall extending from the top to the bottom, the sidewall having an opening therein leading to the hollow interior; a decorative insert configured and sized in relation to the base member to be inserted within the hollow interior through the sidewall opening and viewable through the top opening; and a retainer for retaining said decorative insert within said base member hollow interior.

In one preferred embodiment of the invention, the base member is segmented, defining a plurality of base member segments each having a decorative top, fixedly connected together side-by-side. Similarly, the cap is segmented, defining a like plurality of cap segments each having an opening therein, fixedly connected together side-by-side; and the cap attachment means is adapted to attach the segmented cap to the segmented base member with at least a portion of each decorative top being viewable through the cap openings.

In another aspect of the invention, there is provided a decorative jewelry item, comprising: a base member having a hollow interior, a top with an opening therein leading to the hollow interior, a bottom, and a sidewall extending from the top to the bottom; and a decorative insert configured and sized in relation to the base member top opening to be inserted, through the top opening, into the hollow interior and positioned below the top; the decorative insert being fixed within the base member hollow interior with the decorative insert viewable through the top opening.

The invention embodies both the construction or constructions of a decorative jewelry item as well as the method or methods for making a decorative jewelry item.

It will be appreciated that, in accordance with the principles and concepts of the present invention, since the decorative object, decorative insert, or simulated decorative object or insert, is typically positioned below the top of the decorative jewelry item and above the bottom of the base member, snagging of clothing, and penetration of the user's skin is avoided. Unlike real gems, the simulated gem of the present invention does not extend below the bottom of the base member in which it is contained.

In another aspect of the invention, there is provided a plurality of such decorative jewelry items joined together. For example, a pair of such decorative jewelry items may be joined together in the manufacturing process so that the number of individual modular units to be assembled, to form a tennis bracelet for example, is halved.

The present invention also provides for a number of selectable structural configurations and mounting processes, depending on need, desired security for a mounted gem or simulated gem, and aesthetic considerations.

In the most preferred embodiments of the invention, the decorative insert or object is mounted within its single or multiple segmented base member with no part of the insert extending above the top rim, or bezel, of the base member. However, it will be understood that even if the decorative insert or object protrudes a small distance above the top rim, or bezel, clothing will not be snagged, and the slightly exposed top surface of the insert or object above the top rim, or bezel, will not be sufficient to scratch objects or the user's skin. If desired, in the manufacture of the decorative insert or object, a process step may be applied to round over, bevel, or otherwise soften the peripheral edges of the insert or object to assist in minimizing snagging of clothing or scratching objects or the user's skin. Accordingly, a secondary preferred embodiment of the invention will have the top surface of the decorative insert or object at the same level of, or slightly above, the top rim, or bezel, of the base member.

BRIEF DESCRIPTION OF THE DRAWING

These and other aspects of the invention will be better understood, and additional features of the invention will be described hereinafter having reference to the accompanying drawings in which:

FIG. 1 is a front perspective view of a dual segment base member having an integral decorative top;

FIG. 2 is a rear perspective view of the base member shown in FIG. 1;

FIG. 3 is a side perspective view of the base member shown in FIG. 1;

FIG. 4 is a bottom perspective view of a dual segment cap for the base member shown in FIG. 1;

FIG. 5 is a front perspective view of the dual segment cap;

FIG. 6 is a side perspective view of the dual segment cap;

FIG. 7 is a side perspective view illustrating the method of placing a dual segment cap over the top of a dual segment base member;

FIG. 8 is a view similar to that of FIG. 7, but with the cap fully assembled to the base member, defining a finished decorative jewelry item;

FIG. 9 is a front perspective view of the assembled jewelry item shown in FIG. 8;

FIG. 31 is a front perspective view of a dual segment base member having a recess formed concentrically in each of the segments;

FIG. 32 is a cross sectional view of one of the segments of the base member shown in FIG. 31, taken along the line 32—32, with a separate decorative object captured loosely in the recess of the base member and between the base member and applied cap;

FIG. 33 is a view similar to that of FIG. 32, but without and opening in the bottom of the recess in the base member;

FIG. 34 is a top view of a dual segment cap illustrating different shape and size possibilities for the cap segments, and in particular a wavy inner edge and a thin annular configuration;

FIG. 35 is a top view of a dual segment cap illustrating different shape and size possibilities for the cap segments, and in particular a scalloped interior edge and a fillagree pattern structure;

FIG. 36 is a top view of a dual segment cap illustrating different shape and size possibilities for the cap segments, and in particular a cloverleaf-like interior edge and star shaped fillagree pattern structure;

FIG. 37 is a top view of a dual segment cap illustrating different shape and size possibilities for the cap segments, and in particular a square interior edge and a heart shaped interior edge;

FIG. 60 is a front perspective view of a dual segment base member, each segment having a sidewall with an opening therein;

FIG. 61 is a side perspective view of the base member shown in FIG. 60;

FIG. 62 is a front perspective view of a decorative object to be inserted in the base member of FIGS. 60, 61;

FIG. 63 is a view similar to that of FIG. 60, with a pair of decorative objects shown in FIG. 62 being inserted into the sidewall openings in the base member;

FIG. 64 is a fully assembled dual segment decorative jewelry item comprised of the base member shown in FIG. 60 and a pair of decorative objects shown in FIG. 62;

DETAILED DESCRIPTION OF THE PREFERRED EMBODIMENTS

Figure 10:
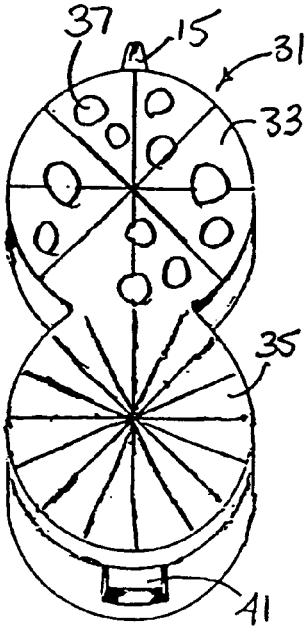
FIG. 10 is a front perspective view of a dual segment base member in which the decorative top of each segment exhibits a different visual appearance or property.

A first embodiment of the invention is shown in FIGS. 1–9. FIGS. 1–3 represent the front, rear, and side perspective views of the base member 2. In this embodiment, each decorative jewelry item 1 (FIG. 8), hereinafter also referred to as a module or modular link, is segmented to define two segments 3 and 5 in a substantially figure-8 shape. The dual segmented base member 1 has a segmented decorative top 7, 9, exhibiting a design representing a diamond cut surface on each segment. In the embodiment of FIGS. 1–9, the diamond cut design is formed integrally on the top surface of the base member 2. As will be described below, an alternate embodiment may employ a separate decorative object fixed to the top surface of the base member 2.

The base member 2 preferably has a hollow interior defined by a thin sidewall 6 extending downwardly from the decorative top 7, 9, the sidewall 6 having at least one cutout 13 extending through sidewall 6 into the interior of the base member 2.

The cutout 13 is provided to accept a prong from a cap member to be described hereinafter.

To enhance the beauty of the decorative jewelry item, to lighten it, to conserve precious metal, and to make it have more of a delicate appearance, the sidewall 6 may be provided with a series of side windows 11 also opening to the interior of the hollow base member 2. The windows 11 provide a convenient placement for the cutouts 13, i.e. at the top of the window just beneath the decorative top 7, 9 of base member 2. It will be appreciated that a prong from above can be bent into window 11 and fill cutout 13 if the prong is bent over toward the interior of the base member 2.

A connector tongue 15 is provided at the rear of the decorative jewelry item for insertion into a front window 17 of an adjacent decorative jewelry item.

FIGS. 4–6 show a bottom, front, and side perspective view of a dual segment cap 19 designed and configured to fit over the top of the dual segment base member 2 and secured thereto.

As best understood by reference to FIGS. 4, 7, and 8, the inner diameter of each sidewall 27 of the segmented cap 19 has a diameter slightly greater than the respective decorative tops 7, 9 of the base member 2. Thus, when the cap 19 is brought down over the top of the base member 2 (see FIG. 7), the prongs 21 slide over the side of sidewall 3,5 in alignment with cutouts 13, and the cap 19 ultimately fits over the top of base member 2 with the downwardly directed peripheral wall 27 covering a relatively small top portion of the base member sidewall 3, 5. After the cap 19 is in place, the prongs 21 are bent inwardly through the sidewall windows 11, and due to the width and depth of the cutout 13 being slightly larger than the width and thickness of the prongs 21, after prongs 21 are bent inwardly, they are not visible from a side viewing position of the completely assembled decorative jewelry item 1 (see FIG. 8).

As seen in FIG. 9, the finished decorative jewelry item is an attractive dual segmented modular link which can, when connected to other modular links of the same kind, form a tennis bracelet with the decorative diamond cut surfaces 7, 9 being seen through the openings 23, 25 of the cap 19.

Preferably, the embodiment of the invention shown in FIGS. 1–9 is provided with four windows 11 on each side of the decorative jewelry item, or two per segment side (see FIG. 3), with the two windows nearest the ends having a cutout 13 on the surface forming the windows 11. Since the decorative jewelry item is symmetrical, the embodiment of FIGS. 1–9 embodies a total of eight windows and four cutouts.

Similarly, as seen in FIG. 4, the cap 19 comprises four prongs 21, but the number of prongs 21 and window cutouts 13 can range from one to eight, or even more.

FIG. 10 is a front perspective view of a base member 31 in which, like the base member 2 of FIG. 1, is provided with an integral decorative top 33, 35 on two base member segments. The diamond cut surface of decorative top segment 35 is similar to that shown in FIG. 1, but with a larger number of radial cuts. However, the other decorative top 33 shows a lesser number of radial diamond cuts in the surface thereof, but such diamond cuts are formed after the decorative top segment 33 is provided with a number of holes 37. The holes can be arranged orderly, or, as seen in FIG. 10, they can be of random sizes, random shapes, and random positions on the decorative top 33.

Figure 11:
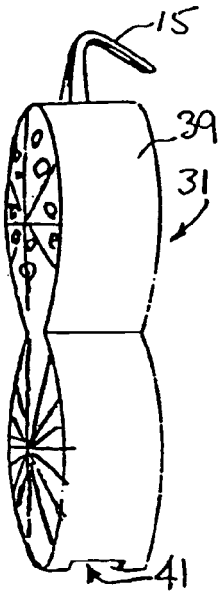
FIG. 11 is a side perspective view of the dual segment base as shown in FIG. 10.

FIG. 11 is a side perspective view of the base member 31 showing that no side windows are provided in the sidewall 39.

A front end window 41 is formed at the opposite end from the connector tab 15 for accommodating the connector tab of an adjacent modular link when the finished decorative jewelry item is in the form of a tennis bracelet, for example. In such an arrangement, the connector tab 15 is inserted in an adjacent end window 41 and then bent around the bottom ledge of window 41.

Figure 12:
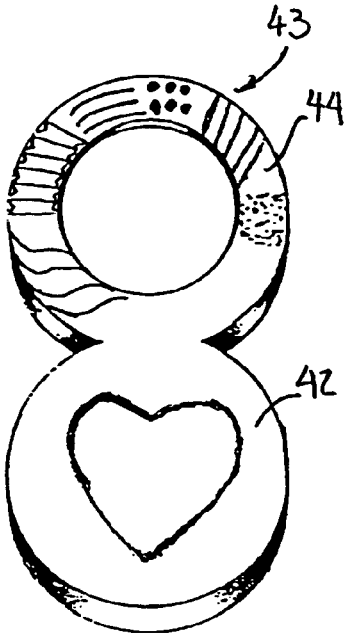
FIG. 12 is a front perspective view of a dual segment cap illustrating that a cap member may have any one of a variety of possible shapes for the openings therein and for the texturing and design of the major top surface of the cap.

FIG. 12 is the top view of a variation of the cap shown in FIG. 5, with no depending prongs. In FIG. 12, one-half of the cap 43 has a circular opening therein, while the other half has a heart shaped opening. The top surface 42 of the segment with a heart shaped opening is plain, while the segment with a circular opening contains multiple design patterns and textures on its top surface 44, it being understood that the designs and textures shown are examples only of what can be done to the surfaces. Preferably, there will not be multiple patterns on any surface of the cap, i.e. if the surface is to be textured, for example, then the whole top surface will be of the same texture.

Figure 13:
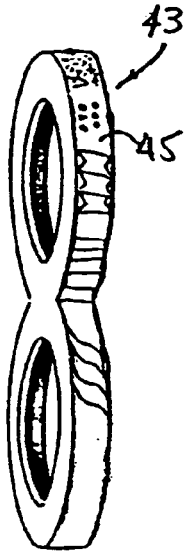
FIG. 13 is a side perspective view of a dual segment cap showing a variety of possible sidewall texturing or designs.

FIG. 13 is a side perspective view of a dual segment cap similar to that shown in FIG. 6, again without any mounting prongs. The side surfaces 45 of the cap 43 show multiple designs and texturing, and again if the side surface is to be textured, the entire side will be of the same texture. However, the design or texture on the side 45 of cap 43 does not necessarily have to correspond to the design or texture of the top surface.

Figure 14:
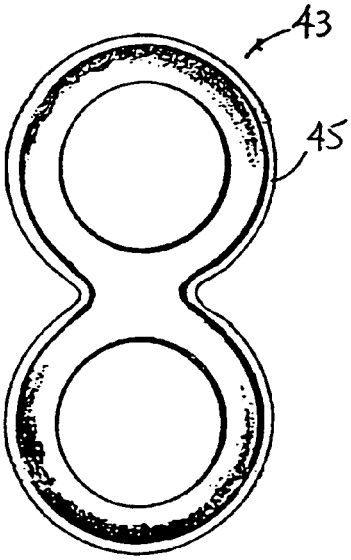
FIG. 14 is a bottom view of an alternate dual segment cap configuration without mounting prongs.

FIG. 14 shows the bottom view of the cap shown in FIG. 13, but without showing any design or texturing. Since there are no prongs, the sidewall 45 of cap 43 has an inner diameter slightly greater than the diameter of the segments of the base member 31, allowing the cap 43 to cover the top portion of the base a short distance.

Figure 15:
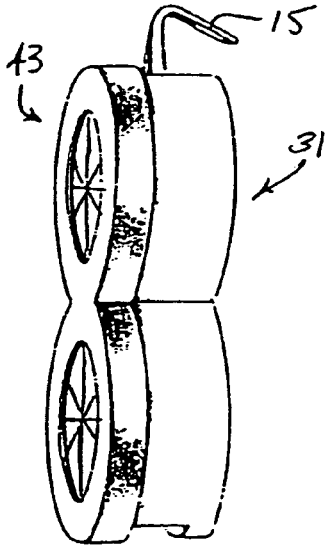
FIG. 15 is a fully assembled dual segment decorative jewelry item employing a base member similar to that shown in FIG. 11, and a cap structure similar to that shown in FIG. 14.

FIG. 15 shows the finished assembly of FIG. 11 and FIG. 13 with optional identical diamond cut decorative tops on the two segments of the base member 31 viewable through identical circular openings in the cap 43 which is devoid, in FIG. 15, of any design or texturing. Since there are no prongs or cutouts in the FIG. 15 assembly, the cap 43 is fixed to the base member 31 by means of soldering, welding, adhesive, or other known adhering processes.

FIGS. 16–24 are very similar to FIGS. 1–9, respectively, with some notable differences. One difference is that, in the embodiment of FIGS. 1–9, the top of the base member 2 has diamond cut patterns formed thereon, while in FIGS. 16–24, the decorative top of the base member 51 comprises a planar top surface 53, 57 upon which is fixed two separate, and individual, decorative objects, 55, 59. This is best viewed in FIGS. 17 and 18.

A second difference to be noted is that a number of vertical channels 61 are provided around the periphery of the base member 51, channels 61 extending through the top surface 53, 57 of the base member 51 downwardly to corresponding open windows 56 in the sidewalls of the base member segments 52, 54. The windows 56 correspond in number and placement the same as windows 11 of the embodiment of FIGS. 1–9. Preferably, the channels 61 are provided in alignment with the outermost windows, i.e. the sidewall windows 56 closest to the short ends of the dual segment decorative jewelry item.

Figure 19:
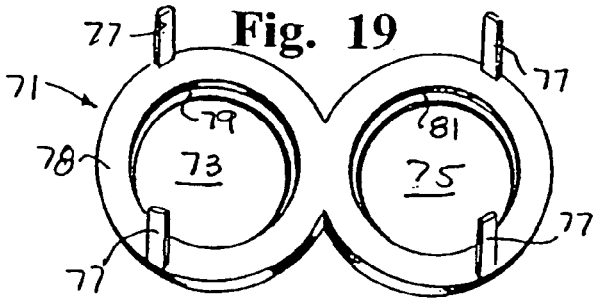
FIG. 19 is a bottom perspective view of a dual segment cap for the base member shown in FIG. 16.
Figure 20:
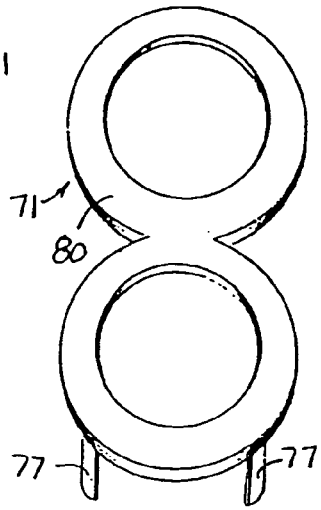
FIG. 20 is a front perspective view of the dual segment cap.
Figure 21:
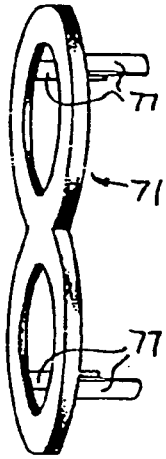
FIG. 21 is a side perspective view of the dual segment cap.
Figure 22:
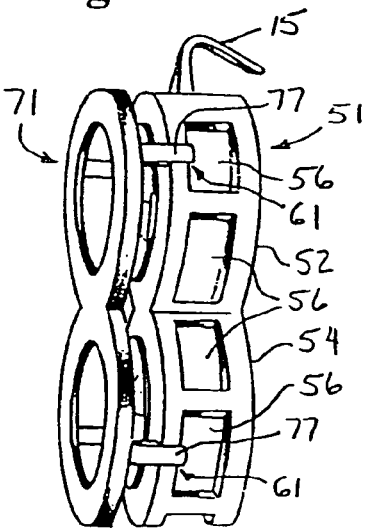
FIG. 22 is a side perspective view illustrating the method of placing of a dual segment cap over the top of a dual segment base member.

The purpose for the channels 61 can be appreciated by referring to the associated cap 71 shown in FIGS. 19–21, in which a plurality of rectangular prongs 77 extend from the lower surface of the cap 71 and are not visible in a top view due to such placement. The cap 71 has a pair of openings 73, 75 through which the decorative objects 55, 59 can be observed when the decorative jewelry item is completely assembled. As seen in FIG. 19, a recess 79, 81 is provided in each segment of the dual segment cap 71, the diameter of the decorative objects 55, 59 being larger than the diameter of the cap openings 73, 75, but smaller than the diameter of the recesses 79, 81. Unlike the cap 19 shown in FIGS. 4–6, the cap 71 is the same length and width as the base 51. In FIG. 19, the cap 71 is shown to have a flat bottom surface 78, and the recess 79 is not as noticeable compared to the recess 24 of cap 19, recess 79 intending to cover only the diamond cut decorative objects 55, 59 projecting into the cap recesses 79,81.

Thus, when the cap 71 is brought down over the top of base member 51, since both cap 71 and base member 51 have the same length and width, prongs 77 fit perfectly into and slide through channels 61 until the cap 71 is seated on the base member 51 with the bottom of the cap resting on the top surface 53, 57 of the base member 51, and the decorative objects 55, 59 being framed by the openings 73, 75 in the cap 71.

The two decorative objects 55, 59 are described separately in this description to indicate that the design and shape of such decorative objects 55, 59 need not necessarily be identical as they appear to be in FIGS. 16–24.

Figure 23:
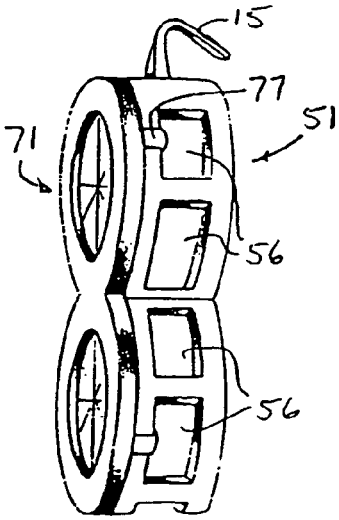
FIG. 23 is a view similar to that of FIG. 22, but with the cap fully assembled to the base member, defining a finished decorative jewelry item.

After contact between the cap 71 and base member 51, the prongs 77 are bent inwardly through the respective windows 56, and, because the thickness of the prongs 77 is made to be the same as the depth of channels 61, after the prongs 77 are bent over, as shown in FIG. 23, the prong/channel attachment arrangement is barely visible.

Figure 16:
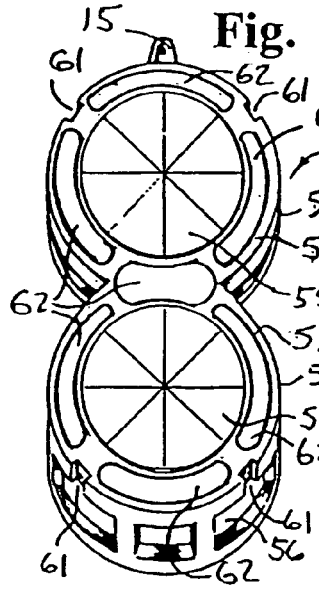
FIG. 16 is a front perspective view of a dual segment base member having a decorative top, the base member decorative top including a base member top surface and a separate decorative object fixed thereon and a number of mounting channels on the sides of the base member.
Figure 17:
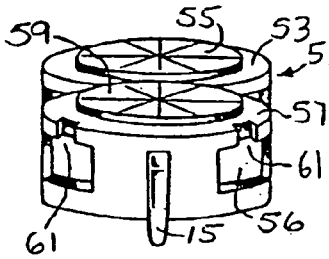
FIG. 17 is a rear perspective view of the base member shown in FIG. 16.
Figure 18:
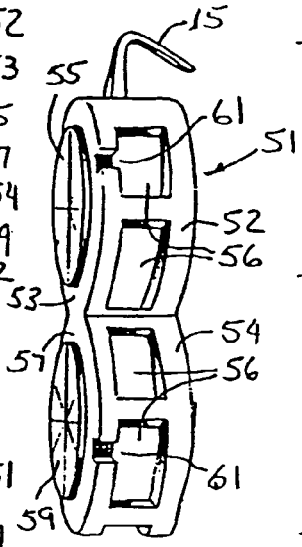
FIG. 18 is a side perspective view of the base member shown in FIG. 16.

A third difference is seen in the provision of a number of through holes 62 formed in the surface of the base member top surfaces 53 and 57 outside the periphery of the decorative objects 55 and 59 (shown in FIG. 16 only, for convenience). The purpose of these through holes 62 is to reduce the amount of precious metal or material of the base member 52,54. By placing the holes 62 in a pattern such as that shown in FIG. 16, a significant amount of base material, e.g. gold, will be saved, and yet the physical integrity of the finished decorative jewelry item will not be diminished. Because the holes 62 are covered and hidden from view by the cap 71, they will not detract from the beauty of the item. Additionally, such through holes 62 in the base member 52,54 will also lighten the article of jewelry, e.g. a tennis bracelet, which comprises a number of decorative jewelry items 51. This would be a desirable feature especially for women. Through holes of this type for reducing the amount of precious metal or material can be formed in virtually all of the decorative jewelry item base members shown and described herein, and the variation shown in FIG. 16 is to be considered exemplary only.

Figure 24:
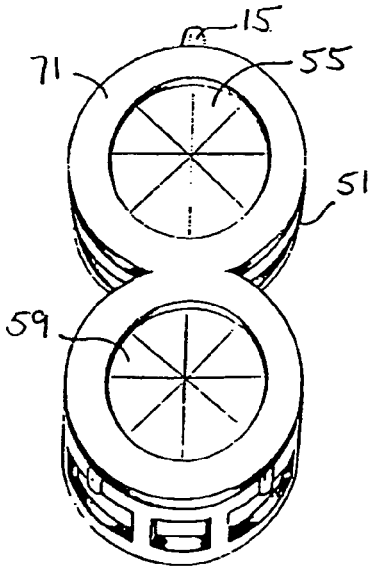
FIG. 24 is a front perspective view of the assembled jewelry item shown in FIG. 23.

FIG. 24 is a front perspective view of the completely assembled decorative jewelry item employing the base 51 and cap 71, as described.

Figure 25:
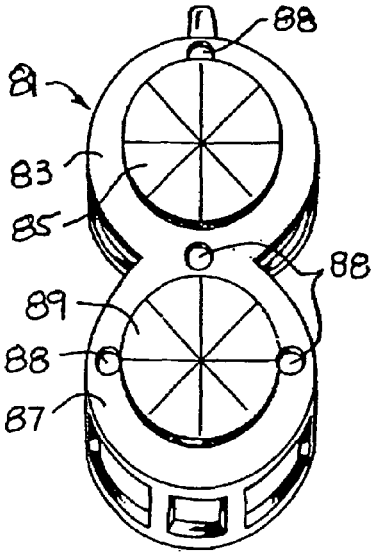
FIG. 25 is a view similar to that of FIG. 16 with circular through holes in the top surface of the dual segment base member replacing the channels shown in FIG. 16.
Figure 26:
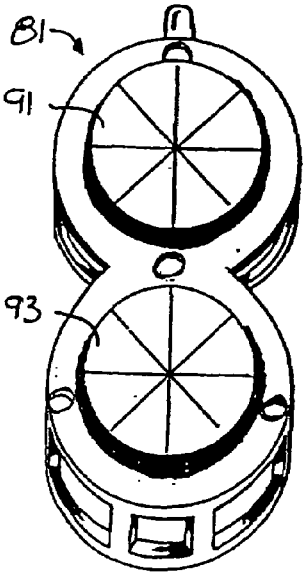
FIG. 26 is a view similar to that of FIG. 25 with the exception that each separate decorative object placed on the top surface of the dual segment base member has a greater thickness than that shown in FIG. 25.
Figure 27:
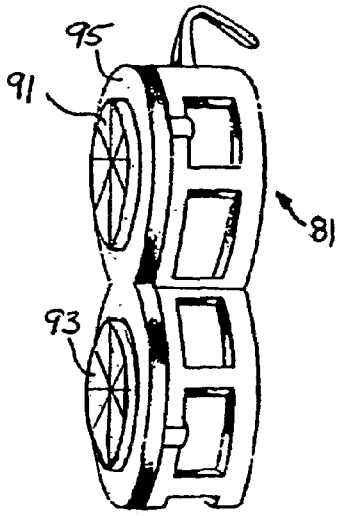
FIG. 27 is a dual segment completed decorative jewelry item employing the thickened decorative object shown in FIG. 26 which protrudes through the cap of the assembly.

FIGS. 25–27 show another attachment arrangement for attaching a cap to a base member. In these figures, the base member 81 has a planar top surface on the two segments 83, 87 upon which are fixed a pair of decorative objects 85, 89. In the top surface 83, 87 of the base member 81, a number of circular holes 88 are formed, and a cap 95, similar to that shown in FIG. 19 is provided, but with the depending prongs being circular in cross section and positioned on the bottom surface of the cap 95 away from the outer peripheral edge and to be in alignment with holes 88 of the base member 81. Thus, when the cap 95 is brought down over the top of base member 81, the prongs will slide through holes 88 and be bent over (not shown) in the interior of the hollow base member 81. The number of holes 88, and the number of prongs, can vary from one to eleven, or even more.

The base member of FIG. 26 is similar to that shown in FIG. 25, except that the thickness of the two decorative objects 85, 89 are considerably thicker. A cap 95 is chosen to have a central opening just slightly larger than the diameter of the thickened decorative objects 91, 93, such that when the cap is brought down over the base member 81, the thickened decorative objects 91, 93 project through and extend above the top surface of the cap 95, as best seen in FIG. 27 showing the completed article.

Figure 28A:
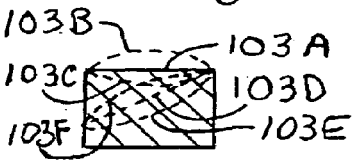
FIG. 28A is an enlarged cross section of one side of the cap segment taken along the line 28A—28A in FIG. 28.
Figure 28:
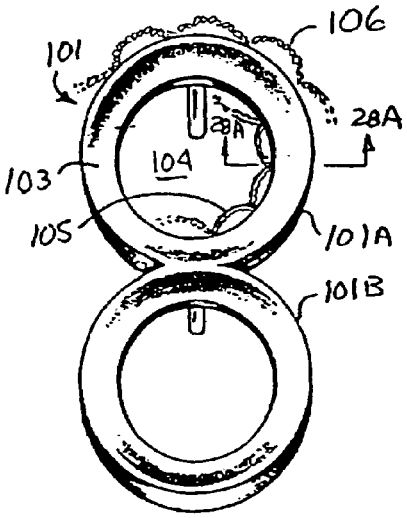
FIG. 28 is a dual segment cap illustrating the possibility of a non-planar top surface of the cap and the possibility of at least partially covering the opening in the cap with a filagree-like structural design.

FIG. 28 shows a variation of a cap 101 having a pair of annular shaped segments 101A,101B with the top surface 103 of each cap segment being conical/concave in shape to enhance the beauty of the finished product. FIG. 28 also shows the possibility of adding an open filagree-like design structure 105 to the inner periphery of the opening 104 and/or an open filagree-like design structure 106 to the outer periphery of the cap segments 101A, 101B.

FIG. 28A is a cross section of one side of the cap segment 101A taken along the line 28A—28A in FIG. 28. This figure illustrates, in solid and dashed lines, several possibilities for the shape of the top surface 103, i.e., a planar and horizontal shape 103A, a convex shape 103B, a concave shape 103C, a linear conical shape 103D, a conical-concave shape 103E, and a conical-convex shape 103F. These shape variations can be chosen by the designer for cap configurations other than annular; for example, such shapes can be applied to a heart shaped cap segment such as those shown in FIG. 29.

Figure 29:
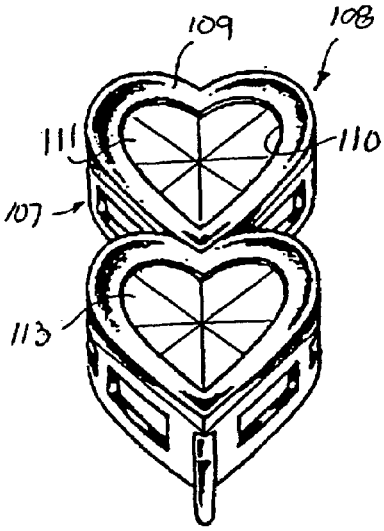
FIG. 29 is a dual segment finished decorative jewelry item in which the base member segments and the cap segments are heart shaped, and the top surface of the cap segments are concave.

FIG. 29 shows a finished decorative jewelry item in which both segments of the base 107 are heart shaped and both segments of the cap 108 are heart shaped and, like that of FIG. 28, the cap 108 has a concave peripheral upper surface 109 and a heart shaped opening 110 to expose the decorative objects 111, 113 beneath.

Figure 30:
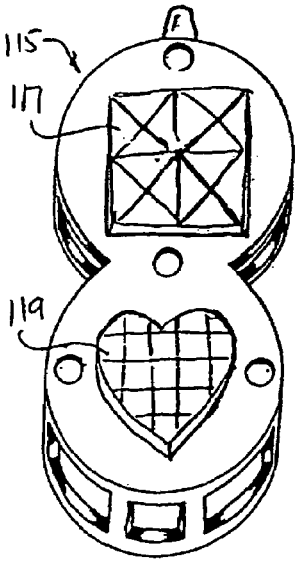
FIG. 30 is a view similar to that shown in FIG. 25, but with the fixed decorative objects mounted on the top surface of the base member being of different shapes and designs for the two segments.

FIG. 30 illustrates the possibility that the decorative objects 117, 119 fixed to the base member 115 may be of any particular desirable configuration and formed by any means of diamond cutting or other surface enhancing processes. In FIG. 30, the top decorative object 117 is square in configuration with crisscross diamond cut features, and the lower decorative object 119 is heart shaped with a square matrix of diamond cut lines.

It will be understood that the geometric shape of the opening in any cap in accordance with the present invention need not be the same geometric shape as the decorative object below. For example, instead of using a heart shaped decorative object 119 in FIG. 30, a square or circular shaped decorative object could be fixed to the base member 115, and the opening in a cap (not shown) fitted over base member 115 may be heart shaped.

FIGS. 31–33 show embodiments of the invention into which a decorative object 121 is loosely captured or entrapped between a base member 123 and a cap 129. The base member shown in FIG. 31, for example, has a planar upper surface 125 and a pair of concave, or right angled, recesses 127. The bottom of the recess 127 may have an opening 129 in it to conserve precious metal material, since that part of the finished jewelry item will not be seen.

FIG. 32 is a cross sectional view taken along the line 32—32 in FIG. 31, wherein it can be seen that when the cap 129 is brought into contact with the planar surface 125 of the base member 123, there exists a void within the decorative jewelry item within which the decorative object 121 is loosely contained. This permits the decorative object 121 to move around within the confines of the finished decorative jewelry item, giving an interesting aspect to the item of jewelry.

In addition to, or instead of, providing a recess 127 in the base member 123, the cap 129 may be provided with a recess 131 of sufficient depth to permit the loose mounting of the decorative object 121 captured between the cap 129 and the base 123. For example, a cap designed similar to that shown in FIG. 19, but with a greater depth for the recess 131 could be employed for this purpose. Importantly, the opening 129 in the base member 123 and the opening 133 in the cap 129 are smaller in dimension than the decorative object 121 so as to avoid the possibility of the decorative object 121 falling out of its setting.

FIG. 33 is similar to that of FIG. 32 with the exception that the bottom 135 of the recess 127 of base member 123 has no opening.

FIGS. 34–37 show, schematically, several possible shapes and configurations for the cap openings. The outer shapes for the caps in these figures is, but is not limited to, a figure-8 shape. The cap 141 of FIG. 34 shows a cap segment having an undulated or wavy interior edge, while the annular cap segment 145 is intended to show that the radial width of the cap segment can be made quite thin, whereby a decorative object may be exposed through the opening therein, while the surface of a base member upon which it is mounted may also be exposed to view and display interesting surface textures or designs (see FIG. 43, for an example).

When the outer diameter of the bottom cap segment 145 is, instead, made equal to the outer diameter of the base member segment, the thinness of the cap segment 145 will display the decorative top of the base member larger than a regular sized cap opening.

FIG. 35 shows a cap 147 with one segment 149 having a scalloped interior edge 146 and/or a scalloped exterior edge 148 (shown as an option in dashed lines), and the other cap segment 151 having a thin annular width with an open filagree-like pattern design 152 formed on the inner peripheral surface and/or an open filagree-like design 154 formed on the outer peripheral surface.

FIG. 36 shows a cap 153 with one cap segment 155 having a cloverleaf or wide cross opening, while the other segment 157 has a circular opening with a filagree-like or thin filament arrangement forming a star over the opening therein.

FIG. 37 shows a cap 159 in which one segment 161 has a square opening therein, and the other segment 163 has a heart shaped opening.

It is to be understood that interior and exterior shapes or designs of the cap segments of a dual segment decorative jewelry item may be the same for both segments, or they may be different. For example, FIGS. 34–37 show different designs for the two segments, but a designer may choose to make both segments identical, choosing the desired design for each segment from any one of the examples illustrated or suggested by such illustrations.

Figure 38:
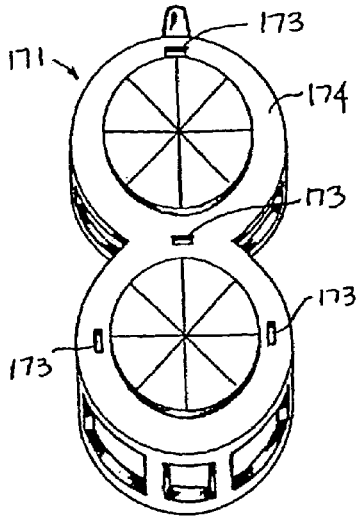
FIG. 38 is a front perspective view of a dual segment base member having rectangular openings in its top surface as opposed to the circular openings shown in FIG. 25.

FIG. 38 is a view similar to that shown in FIG. 25, but with the prong openings 173 in the upper surface 174 of base 171 being rectangular instead of circular.

Figure 39:
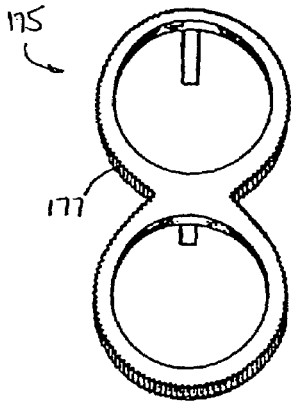
FIG. 39 is a front perspective view of a dual segment cap in which the outside edge is serrated, and the cap has a thin annular radius for each segment.
Figure 40:
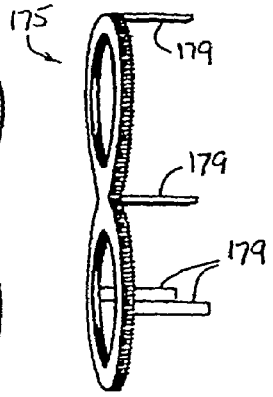
FIG. 40 is a side perspective view of the dual segment cap shown in FIG. 39.

FIGS. 39 and 40 show a front and side perspective view of a cap 175 which has the shape of a figure-8 and has serrations along its entire outer peripheral surface. Additionally, the prongs 179 are rectangular in shape so as to fit within the rectangular openings 173 of the base member 171 shown in FIG. 38.

Figure 41:
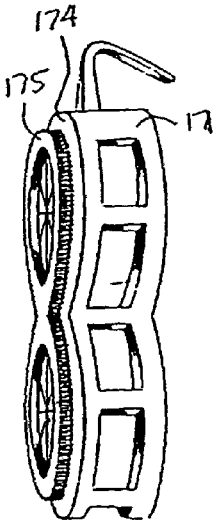
FIG. 41 is a side perspective view of an assembled decorative jewelry item employing the base member from FIG. 38 and the cap from FIG. 39.
Figure 42:
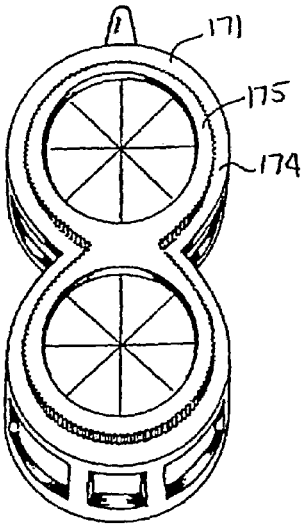
FIG. 42 is a front perspective view of the assembled decorative jewelry item shown in FIG. 41.

FIGS. 41 and 42 are side perspective and front perspective views, respectively, of the assembled decorative jewelry item employing the base 171 of FIG. 38 and cap 175 of FIG. 39. In these figures, it will be observed that the cap 175 has a pair of circular openings exposing the decorative objects below, while the thin radial width of each cap segment is such that a large portion of the upper surface 174 of base 177 is exposed outside of the serrated outer edge of cap 175.

Figure 43:
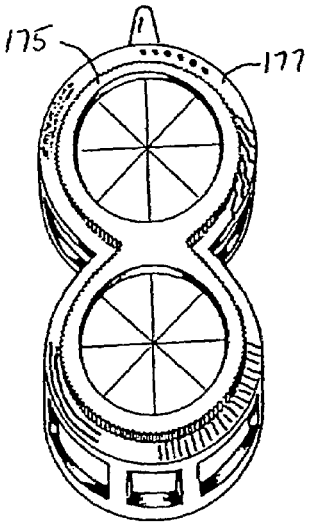
FIG. 43 is a view similar to that of FIG. 42 showing possible major surface texturing or designs for the portion of the top surface of the base member extending radially outwardly of the annular cap segments surrounding the decorative objects fixed to the top surface of the base member segments.

FIG. 43 shows the possibility of providing surface texturing or design features in the portion of the upper surface 177 exposed outside of the installed cap 175.

Figure 44:
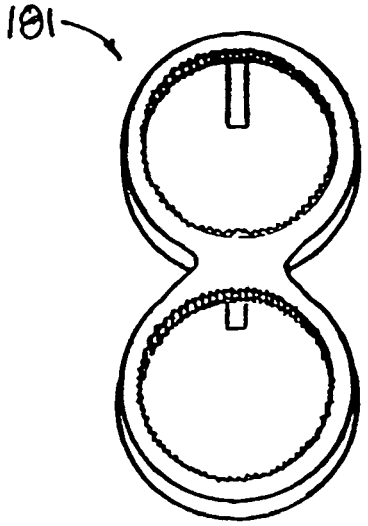
FIG. 44 is view similar to that shown in FIG. 39, except that the outer surface of the cap is plain and smooth, and the inner edge surfaces are serrated.

FIG. 44 is a view similar to that shown in FIG. 39, except that the outer peripheral surface of the cap 181 is smooth, while the interior surface of the two openings therein is serrated, or otherwise textured.

Figure 45:
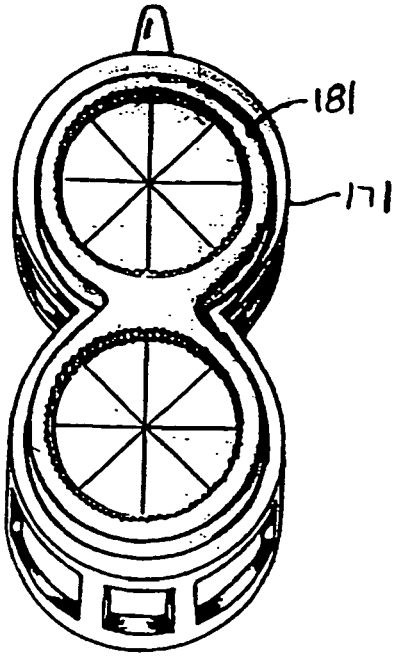
FIG. 45 is a front perspective view of a finished decorative jewelry item employing the base member from FIG. 38 and the cap from FIG. 44.

FIG. 45 is a view similar to that of FIG. 42, except that the cap has the features of FIG. 44 instead of those of FIG. 39. If desired, the top surface of cap 181 may also be serrated, or it may have a conical appearance.

Figure 46:
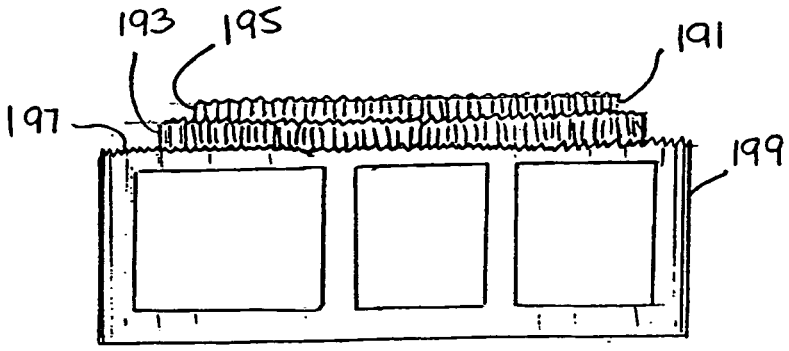
FIG. 46 is a front elevation view of a multi-stepped cap, with each exterior edge serrated, mounted on a base member having a textured top surface.

FIG. 46 is a side view of a decorative jewelry item in which the cap 191 has a multi-stepped configuration, in FIG. 46 only a non-limiting two-step configuration being shown. The outer edges of both stepped portions 193, 195 are serrated, or otherwise textured, and the top surface of each step 193, 195 is also serrated or otherwise textured. For consistency of design, the base member 199 may also be provided with a serrated or otherwise textured upper surface 197.

Figure 47:
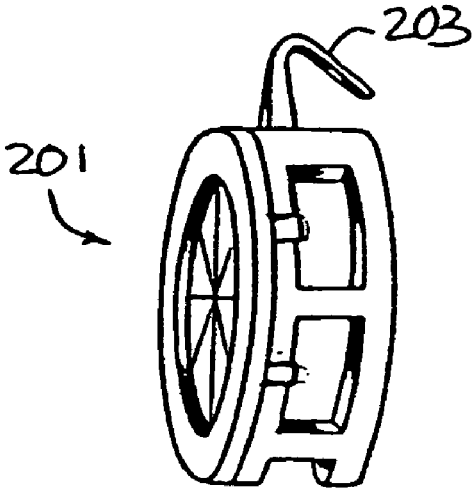
FIG. 47 is a single non-segmented decorative jewelry item having features similar to the dual decorative jewelry item shown in FIG. 23.

FIGS. 47–54 depict single non-segmented decorative jewelry items suggesting several options in the manufacture of such single non-segmented jewelry items. For example, FIG. 47 is a single segment version of the arrangement shown in FIG. 23, the decorative jewelry item 201 having a connector tab 203 for connecting to a similar decorative jewelry item in forming a necklace or tennis bracelet, for example.

Figure 48:
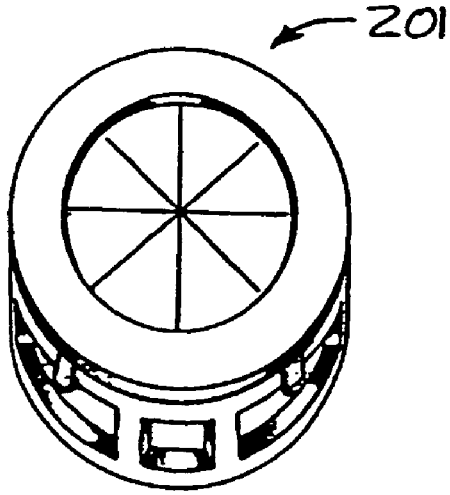
FIG. 48 is a front perspective view of the single decorative jewelry item shown in FIG. 47.

FIG. 48 should be understood to represent a front perspective view of the decorative jewelry item 201 shown in FIG. 47, or it can be understood that the variation shown in FIG. 48 does not have a connector tab 203, and therefore may be inserted into a cylindrical pocket of a larger article of jewelry such as a necklace, pendant, ring, or the like, to be described hereinafter.

Figure 49:
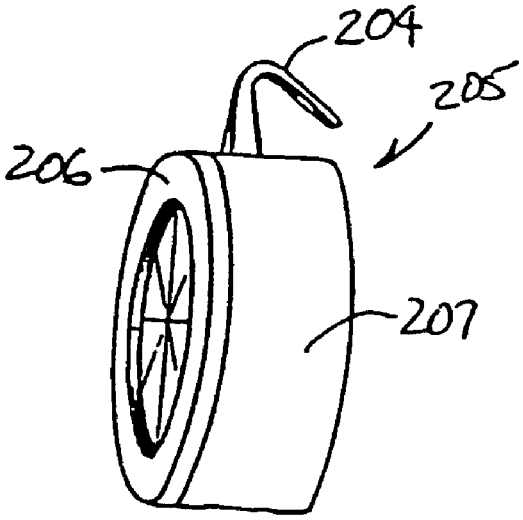
FIG. 49 illustrates the possibility of constructing a single non-segmented decorative jewelry item without employing prongs on the cap and without providing windows in the sidewalls of the base member.

FIG. 49 shows a side perspective view of a decorative jewelry item 205 having a sidewall of base member 207 with no windows formed therein, meaning that the cap 206 is fixed to the base member 207 by means of depending tabs bent over inside the hollow base member 207 or is soldered, welded, or otherwise bonded to base.

Figure 50:
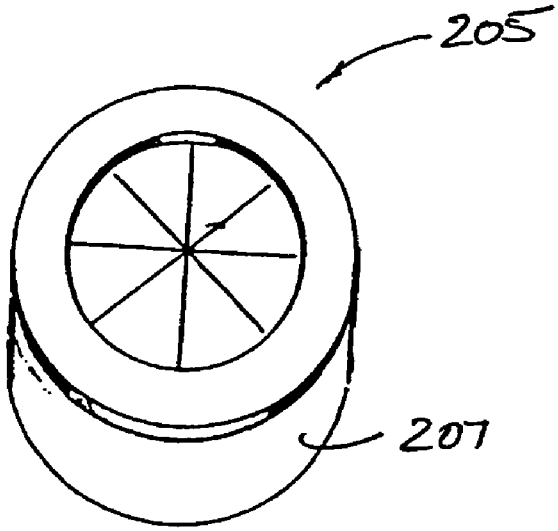
FIG. 50 is a front elevational view of the single decorative jewelry item shown in FIG. 49.

FIG. 50 is a front perspective view of the decorative jewelry item of FIG. 49, but it also may represent a view of a decorative jewelry item 205 without any connector tab 204.

Figure 51:
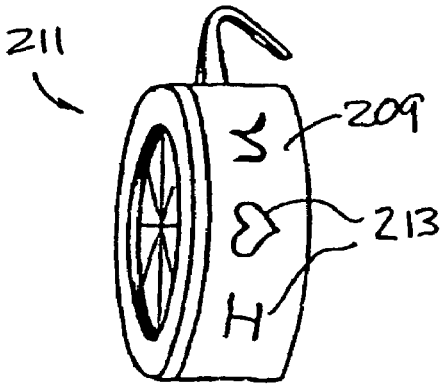
FIG. 51 is a side perspective view of a single non-segmented decorative jewelry item similar to that shown in FIG. 49, but with lettering and/or designs being formed on the sidewall of the base member.

FIG. 51 is a view similar to that shown in FIG. 49, except that the sidewall 209 of the decorative jewelry item 211 has formed therein or thereon a selection of letters and/or symbols 213. The designs and patterns may be cutouts or engravings of shapes and/or letters.

Figure 52:
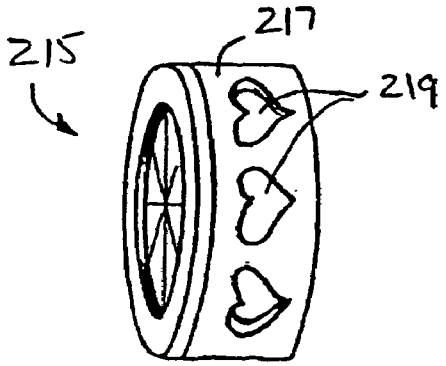
FIG. 52 is a side perspective view of a single non-segmented decorative jewelry item similar to that shown in FIG. 49, but with designed openings in the sidewall of the base member and without any means for attaching to another decorative jewelry item.

FIG. 52 is a side perspective view similar to that shown in FIG. 51 of a decorative jewelry item 215 in which the sidewall 217 has designed openings 219 therein, in FIG. 52 such openings 219 being heart shaped.

Figure 53:
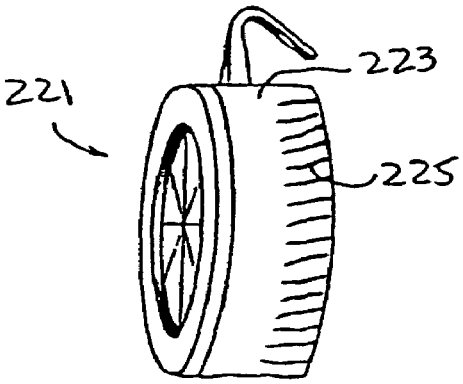
FIG. 53 is a side perspective view of the single non-segmented decorative jewelry item as shown in FIG. 49, except that at least a portion of the sidewall exhibits a line pattern.

FIG. 53 shows a decorative jewelry item 221 similar to that shown in FIG. 49, except that a line pattern is formed on the sidewall 223. The line pattern may be placed over the entire sidewall outer surface or on only selectable locations, at the whim of the jewelry designer.

Figure 54:
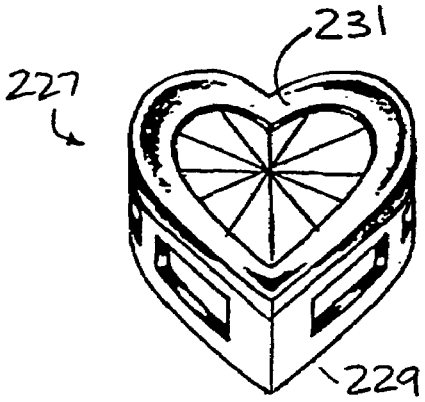
FIG. 54 is a front perspective view of a single non-segmented decorative jewelry item similar to that shown in FIG. 48, except that the base member and cap are heart shaped, and the cap top surface is concave.

FIG. 54 shows a single non-segmented decorative jewelry item 227 having a heart shaped base 229 and a heart shaped cap 231 with a concave upper surface.

Figure 55:
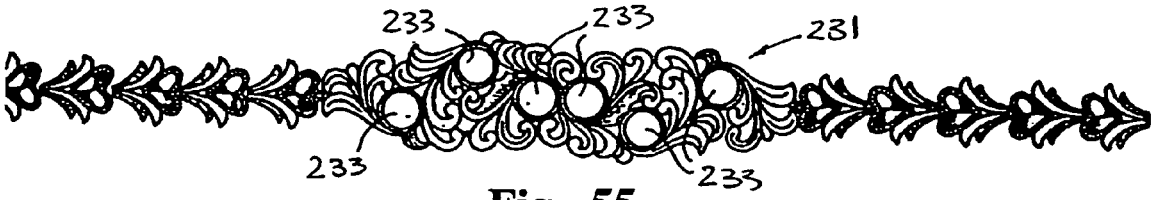
FIG. 55 shows a length of a piece of jewelry, such as a bracelet, having a center structural portion with a number of cylindrical pockets which can receive single non-segmented decorative jewelry items made in accordance with the present invention, such as those shown in FIGS. 48, 50, and 52.

FIG. 55 shows a length of bracelet 231 of arbitrary design having a number of cylindrical pockets 233 formed therein. The pockets 233 are sized to accept any of the single cylindrical non-segmented decorative jewelry items described herein, for example the decorative jewelry item 205 of FIG. 50. An appropriate attaching process is employed to fix the decorative jewelry item 205 in place, such as by soldering, welding, adhesives, etc. Alternatively, instead of forming the bracelet 231 with pockets 233 for insertion of the base member 207 of a complete decorative jewelry item 205, the bracelet 231 itself may be provided with an integral base portion, also numbered 233 in FIG. 55, formed, for example, by casting. With such a construction, there are two possibilities for providing a decorative top for such integral base portion. One possibility is to place a decorative object on the top of the integral base portion, fixed or loose, and fit a cap over the decorative object the same as previously described for a decorative jewelry item employing a separate base member construction. Another possibility is to form the base portion 233 to extend slightly above its surroundings, and form a diamond cut design in the top of the integral base portion 233. Thereafter, only a cap needs to be fitted over the integrally formed base portion 233 to complete the decorative jewelry item. Of course, if the top of the integral base portion 233 extends outwardly far enough, a cap may be applied first, and then the top of the integral base portion 233 can be diamond cut.

Figure 56:
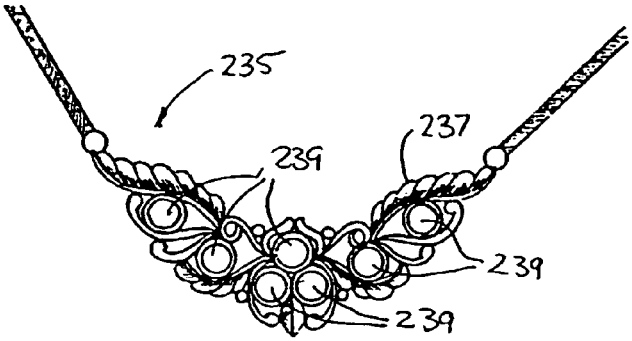
FIG. 56 shows a length of a piece of jewelry, such as a necklace, having a center structural portion with a number of cylindrical pockets which can receive single non-segmented decorative jewelry items made in accordance with the present invention, such as those shown in FIGS. 48, 50, and 52.

FIG. 56 is a portion of a necklace 235 having a center piece 237 of arbitrary design and also containing a number of cylindrical pockets formed therein in areas 239. Again, an insertable decorative jewelry item such as that shown in FIG. 50 may be fixedly attached within the cylindrical pockets in areas 239. Alternatively, as with the bracelet of FIG. 55, in FIG. 56, a base may be integrally formed in areas 239 when the necklace center piece is formed.

Figure 57:
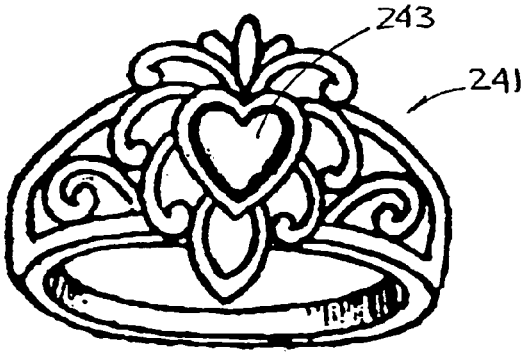
FIG. 57 is a front perspective view of a finger ring having a heart shaped pocket formed therein for receiving a single non-segmented decorative jewelry item made in accordance with the present invention, such as that shown in FIG. 54.

FIG. 57 shows a front perspective view of a finger ring of arbitrary design, except that a front central area of the ring 241 has a heart shaped pocket formed therein in an area 243 for accepting a single non-segmented decorative jewelry item such as that shown in FIG. 54. Alternatively, as with the bracelet of FIG. 55, in FIG. 57, a base may be integrally formed in area 243 when the ring is formed.

Figure 58:
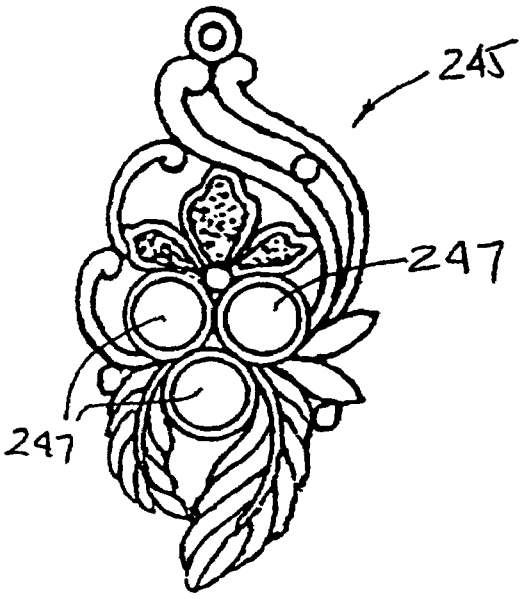
FIG. 58 shows a length of a piece of jewelry, such as a pendant, having a structural portion with a number of cylindrical pockets which can receive single non-segmented decorative jewelry items made in accordance with the present invention, such as those shown in FIGS. 48, 50, and 52.

FIG. 58 similarly shows a pendant, or broach, 245 of arbitrary design having a number of cylindrical pockets formed therein in areas 247 to accept a single non-segmented decorative jewelry item. Alternatively, as with the bracelet of FIG. 55, in FIG. 58, a base may be integrally formed in areas 247 when the pendant or broach is formed.

Figure 59:
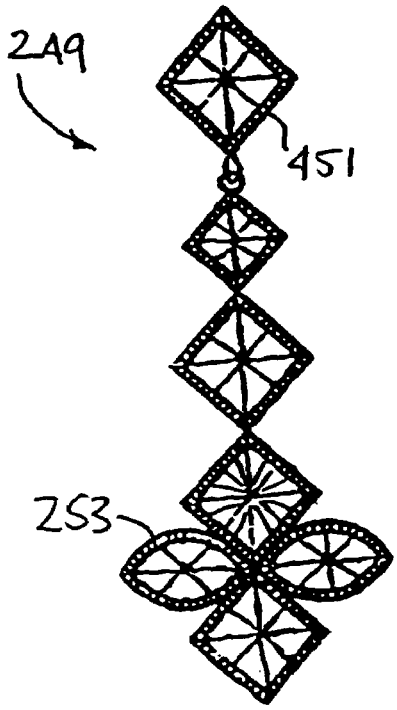
FIG. 59 shows a length of a piece of jewelry, such as an earring, having multiple pockets for receiving differently configured decorative jewelry items in each pocket in accordance with the present invention, such as geometrically altered ones of those shown in FIGS. 48, 50, and 52.

FIG. 59 shows a dangling earring 249 in which a number of rectangular and oval shaped decorative jewelry items 451, 453 are connected together in an unusual and interesting fashion.

The square-shaped or diamond-shaped decorative jewelry items 451 and each of the oval decorative jewelry items 253 are constructed in the same manner as described herein for the manufacture of a single non-segmented decorative jewelry item. The individual portions of the earring 249 may be connected by a wire, string, or coupling member, or they may be, in desired places, soldered, welded, cast together as a unit, or otherwise fixedly bonded together.

FIGS. 60–64 show a decorative jewelry item having the form of a dual base member 261 for receiving a pair of decorative inserts 275 (FIG. 62) either in a fixed position within base member 261 or loosely captured within base member 261.

The base member 261 has a hollow interior, a top 262 with a pair of heart shaped openings formed therein leading to a hollow interior. A sidewall 263 extends from the top surface 262 downwardly and has at least one opening 269 therein in each of the two segments 265, 265 of the base member 261. In the front and side perspective views shown in FIGS. 60 and 61, it will be observed that a pair of bent latch fingers 267 are attached to the bottom of the sidewall 263. In the preferred embodiment, latch fingers 267 are formed on the bottom surface of a window 264 formed at the bottom of the base member 261 in each segment 265, 265.

The base member 261 is manufactured, or prepared during assembly, such that the latch fingers 267 are bent away from the top window opening 269, as best seen in FIG. 61. This permits the insertion of a pair of decorative inserts 275 through the sidewall openings 269 and into the hollow interior of the base member 261, as best seen in FIG. 63. After full insertion of the two decorative inserts 275, the latch fingers 267 are bent upwardly to align precisely with the upper edge of the opening 269 and preferably through a cutout 266 in a support plate 271, 272 shown in FIG. 60. In this manner, the decorative insert 275 is captured within the base member 261 between the base member top 262 and the support plate 271. The upwardly bent latch fingers 267 are soldered or glued in place after the heart shaped decorative inserts 275 are installed.

The support plate 272 is shown to have a heart shaped opening therein, primarily to lessen the amount of precious metal used in the construction of the decorative jewelry item and yet provide adequate support for the heart shaped insert 275.

It will be understood that an adhesive or other type of material or molecular bonding may fix the decorative inserts 275 on the support plates 271, 272, or the decorative inserts 275 may be loosely captured between the support plate 271, 272 and top 262 of the base member 261. In such a case, the openings in the top surface 262 and the support plate 272 must necessarily be of a size smaller than the size of the decorative insert to prevent dislodging of the insert 275 inadvertently.

Figure 65:
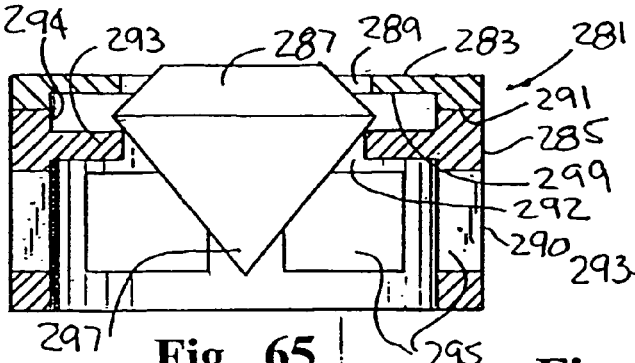
FIG. 65 is a cross sectional view of a variation of the present invention in which the decorative object is a real precious stone, or gem.

FIG. 65 is a cross sectional view of a variation of the present invention in which the jewelry item 281 comprises a real precious stone, or gem 287, as the decorative object captured between a cap 283 and a base member 285. The cap 283 can be secured to base member 285 by any of the methods described above.

The precious stone 287 shown has its widest dimension larger than both the opening 289 in cap 283 and the distance between the inwardly ends of projecting tabs 293 in base member 285. This is best seen in FIG. 66, which is a top view of just the base member 285 of the variation shown in FIG. 65, with the cap removed and with the precious stone 287 schematically represented by a dashed line.

The base member 285 has a depth sufficient to prevent the bottom 297 of the precious stone 287 from extending below the base member, thereby protecting the wearer of the jewelry item 281 from being punctured by the sharp end 297 of the stone 287.

The base member 285 has a sidewall 290 extending downwardly from the decorative top 287,293, the sidewall 290 having a plurality of open windows 295 formed therein. The top surface opening 292 of the base member top surface 293 has an inner peripheral edge 294 and a plurality of tabs 293 projecting inwardly from the peripheral edge, the tabs 293 being of a length sufficient to prevent the precious stone 287 from falling through the top surface opening 292, whereby the precious stone 287 is supported by the tabs 293 with minimal blockage of light entering the sidewall windows 295 and illuminating the precious stone 287 from beneath.

Figure 66:
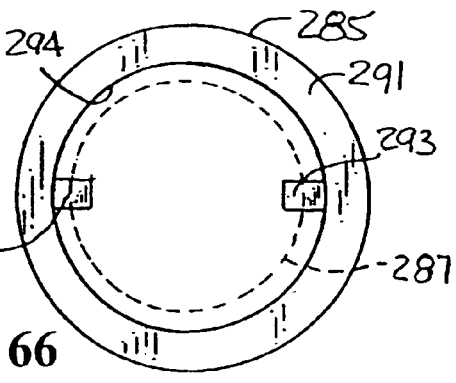
FIG. 66 is a top view of just the base member of the variation shown in FIG. 65, with the cap removed and with the precious stone, or gem, schematically represented by a dashed line.

In a preferred embodiment of FIGS. 65 and 66, the stone 287 is seen to be loosely captured between the cap 283 and base member top surface (i.e., tabs 293 in the embodiment shown). However, it is within the skill of a craftsman to configure and dimension the cap opening 289 and length and number of tabs 293 to clamp the precious stone 287 securely between the cap 283 and base member 285, if desired.

Figure 67:
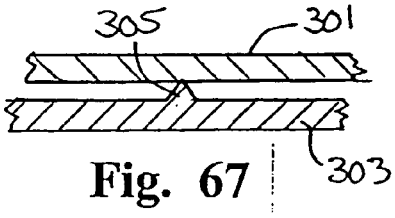
FIG. 67 is a partial cross sectional view of a first type of teetering mechanism between a decorative object and the top surface of a base member.

FIG. 67 is a partial cross sectional view of a first type of teetering mechanism between a decorative object 301 and the top surface of a base member 303. In this variation, the base member top surface 303 extends across the interior of the base member, such as that shown in FIG. 33, wherein the base member top surface 135,303 has an upwardly projecting bump 305 positioned thereon, and the decorative object 121,301 has a bottom which rests on the bump 305, whereby the loosely captured decorative object 301 teeters on the bump 305 functioning as a fulcrum.

Figure 68:
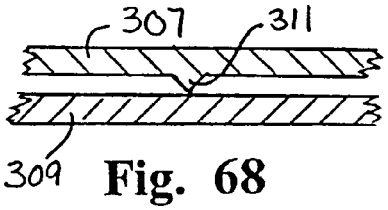
FIG. 68 is a partial cross sectional view of a second type of teetering mechanism between a decorative object and the top surface of a base member.

FIG. 68 is a partial cross sectional view of a second type of teetering mechanism between a decorative object 307 and the top surface 309 of a base member. Here, the base member top surface 309 extends across the hollow interior of the base member, and the decorative object 307 has a bottom with a downwardly projecting bump 311 positioned thereon, whereby the loosely captured decorative object 307 teeters on the bump 311 functioning as a fulcrum. The base member top surface 309 may be a plate-shaped member spanning the entire extent of the interior of the base member, or it may be a band or strap connected at its ends across the extent of the interior of the base member.

Figure 69:
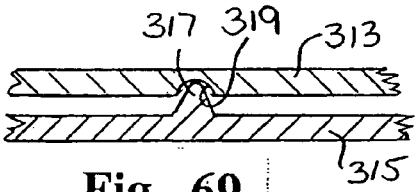
FIG. 69 is a partial cross sectional view of a third type of teetering mechanism between a decorative object and the top surface of a base member.

With reference to FIG. 69, if desired, for more security in keeping the decorative object 301 centered within the decorative jewelry item, the decorative object 313 may have a bottom with a depression 319 therein in alignment with, and sized to receive, the upwardly projecting bump 317 positioned on the base member top surface 315. In such a case, the dimensional design of the cap and base member employing the teetering mechanism of FIG. 69 will be such so as to not permit the bump 317 from exiting the depression 319.

Similarly, and consistent with the variation shown in FIG. 69, the base member top surface 309 shown in FIG. 68 may have a depression (not shown) therein in alignment with, and sized to receive, the downwardly projecting bump 311 positioned on the bottom of the decorative object 307.

Figure 70:
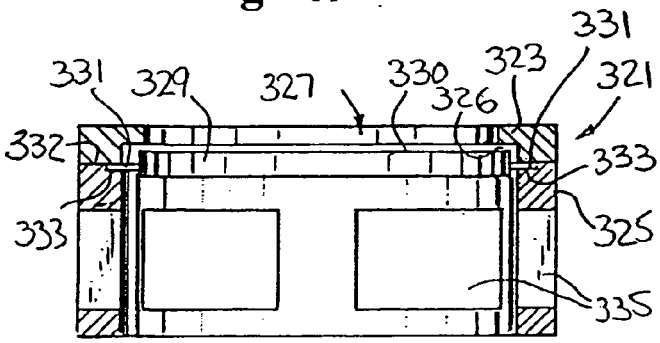
FIG. 70 is a cross sectional view of a base member with a rotatable decorative object pivotally mounted at the top of the base member between the base member and the cap.

FIG. 70 is a cross sectional view of a decorative jewelry item 321 having a cap 323 fitted to a base member 325 with a rotatable decorative object 329 pivotally mounted at the top of the base member 325 between the base member 325 and the cap 323. The decorative object 329 may have a diamond cut upper surface 330, or it may be made decorative by employing any of the surface preparation processes described herein. The cap 323 has a central opening 327 which preferably is sized smaller than the rotatable decorative object 329 so as to keep the decorative object 329 from excessive tilting and exposing an edge above the top of cap 323. Alternatively, the opening 327 may be purposely sized larger to allow the decorative, object 329 to rotate as much as 360°, if desired. Similarly, the base member 325 may have a plate, or strap, or tab (not shown) fixed to the interior thereof to prevent full rotation of the decorative object 329 even when the cap opening 327 is sized larger than the decorative object 329.

Figure 71:
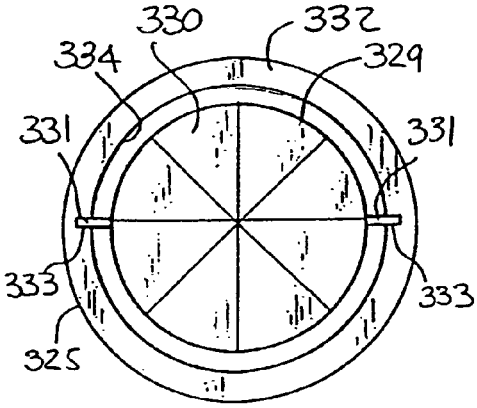
FIG. 71 is a top view of just the base member of the variation shown in FIG. 70, with the cap removed.

Referencing the cross sectional view in FIG. 70 and the top view of the base member and decorative object combination in FIG. 71 with the cap removed, the base member 325 is seen to have a hollow interior, and the decorative top 332,329 thereof comprises: a top surface 332 with an opening 334 therein leading to the hollow interior; and the decorative object 329. The decorative object 329 is rotatably mounted in the recess 326 between the base member 325 and the cap 323 using axially aligned pins 331 resting in, and rotatable in, corresponding oppositely facing side notches 333 formed in the base member top surface 332, whereby the decorative object 329 is free to rotate within the recess 326 about an axis passing through the pins 331. The notches 333 open laterally into the base member top surface opening 334.

FIGS. 72–86 depict alternative constructions in which a decorative insert is inserted, through an opening in the top of a hollow base member (single or segmented), and is fixed within the base member with the insert below the base member top and viewable through the top opening.

Figure 72:
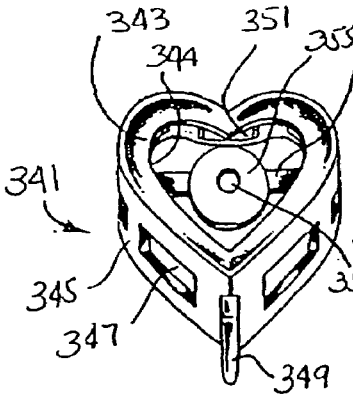
FIG. 72 is a front perspective view of another single segment base member having a sidewall with an opening therein and a support for a decorative insert.
Figure 73:
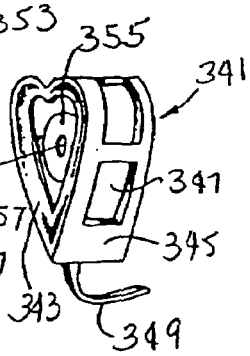
FIG. 73 is a side perspective view of the base member shown in FIG. 72.

In the perspective views of FIGS. 72 and 73, a single heart shaped base member 341 is shown to have a top, or bezel, 343 which may be flat, concave, conical, and/or textured. The top 343 has a heart shaped opening 344 leading to the hollow interior of the base member 341. A sidewall 345 has openings 347, and the base member 341 is provided with a connector tongue 349 which connects with an opening 351 on the opposite side of another base member.

Figure 74:
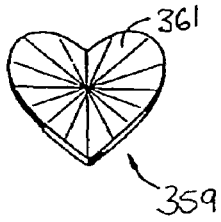
FIG. 74 is a front perspective view of a decorative object adapted to be inserted in the base members of FIGS. 72, 73, 76, 81, 82, and 83.
Figure 75:
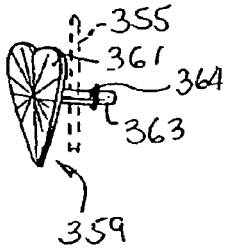
FIG. 75 is a side perspective view of the decorative object shown in FIG. 74.

Spanning across the hollow interior of base member 341 is a support brace 353 having an insert support 355 fixed thereto, the insert support 355 having a hole 357 sized, shaped, and oriented to receive the pin 363 of a decorative object 359 shown in FIGS. 74 and 75. The decorative object 359 comprises a plate-shaped decorative insert 361 having mounting pin 363 projecting from its rear.

Figure 76:
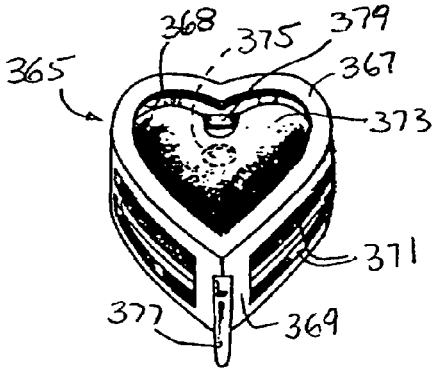
FIG. 76 is a front perspective view of another single segment base member having a sidewall with dual openings therein and a plate-like support for a decorative insert.
Figure 77:
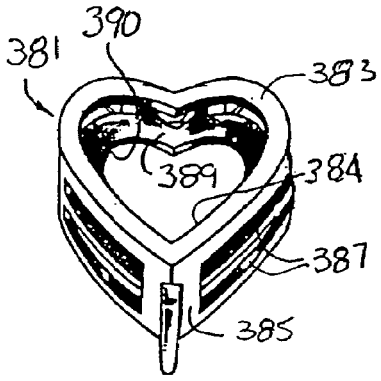
FIG. 77 is a front perspective view of another single segment base member having a sidewall with dual openings therein and a modified plate-shaped support for a decorative insert.

Other configurations of base members which can receive a decorative insert inserted from the top are shown in FIGS. 76 and 77. In FIG. 76, a base member 365, having a top 367, sidewalls 369, a connector tongue 377 and mating rear opening 279, and window openings 371 in the sidewalls 369, also has an insert support in the form of a flat plate-shaped member 373. A flat decorative insert, like that of FIG. 62 may be inserted through the top opening 368 and affixed to the insert support 373 by any known process. An optional hole 375 may be provided to accept a decorative insert of the type shown in FIGS. 74 and 75.

In FIG. 77, a base member 381 having a top 383, sidewalls 385 with windows 387, and an top opening 384, also has an insert support 389. In order to save precious metal, the insert support 389 has a central opening 390 which has negligible effect on the mounting security of a decorative insert affixed to the insert support 384.

Figure 78:
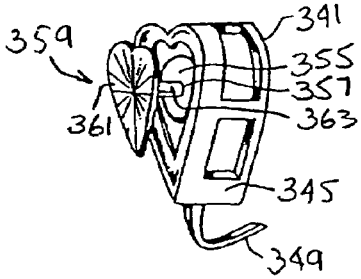
FIG. 78 is a view similar to that of FIG. 73, with a decorative object as shown in FIG. 75 being inserted through the top opening of the base member.
Figure 79:
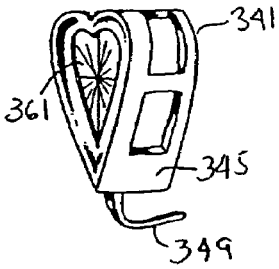
FIGS. 79 and 80 are side and front perspective views, respectively, of a fully assembled single segment decorative jewelry item comprised of the base member as shown in FIGS. 72 and 73 and the decorative object as shown in FIGS. 74 and 75.
Figure 80:
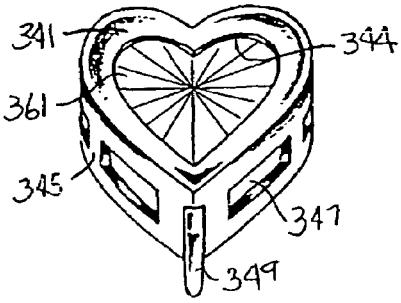
Figure 81:
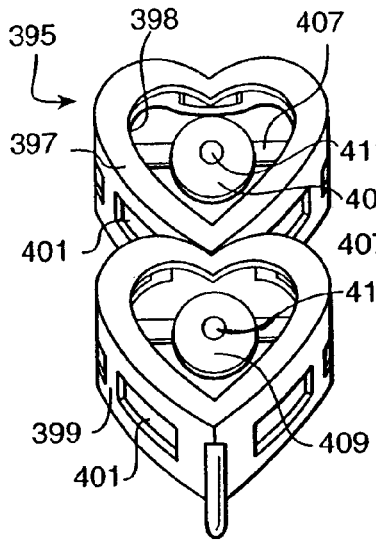
FIG. 81 is a front perspective view of another dual segment base member having a sidewall with openings therein and a pair of supports for two decorative inserts.
Figure 82:
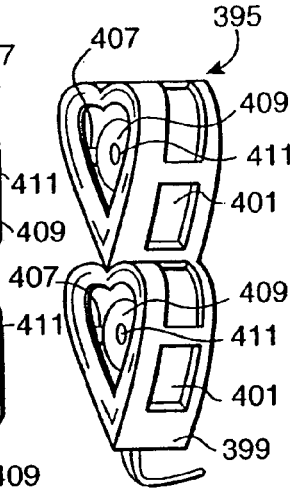
FIG. 82 is a side perspective view of the base member shown in FIG. 81.
Figure 83:
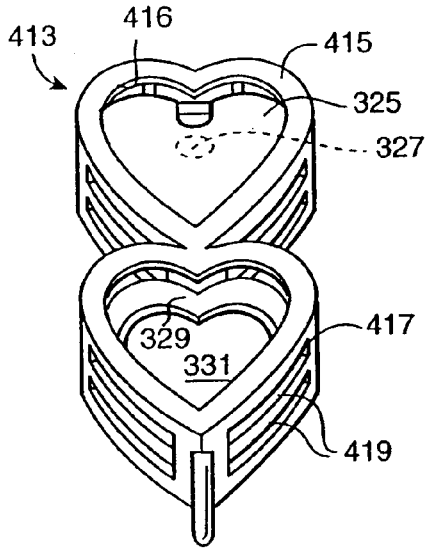
FIG. 83 is a front perspective view of another dual segment base member having a sidewall with dual openings therein and a pair of plate-like supports for a decorative insert, the figure illustrating three different support configuration possibilities.

Turning now to FIGS. 78–80, FIG. 78 shows the decorative object 359 partially inserted in the hole 357 of insert support 355, and FIGS. 79 and 80 show side and front perspective views, respectively, of a fully assembled jewelry article comprising base member 341 and decorative object 359.

Typically, the decorative object 359 will be rigidly fixed to the insert support 355 (or 373, or 389) by a process selected from the group consisting of applying an adhesive, soldering, welding including laser welding, molecular bonding, swaging, bending, and clamping. However, a variation of such an assembly is to fix the decorative object 359 within the hollow interior of base member 341, but permit it to move about when the wearer of the jewelry article moves, thereby creating interesting visual effects.

To accomplish this, rather than to solidly affix the decorative object 359 in place, pin 363 (FIG. 75) can pass through the hole 357,375 in its support 355, 373 and be bent, or have an adhesive, solder, weld, or retainer 364 applied on pin 363 below and spaced from its support 355 or 373 (suggested by the dashed lines 355 in FIG. 75). By making the hole 357, 375 slightly larger than the pin 359, the decorative object 359 is free to rotate and slidably move toward and away from the top of the base member 341, 365 to a limited extent, and if the hole is large enough, the decorative object 359 may additionally tilt, all adding to the visual character of the completed jewelry item.

FIGS. 81–86 illustrate dual segmented versions of the single segment jewelry articles depicted in FIGS. 72–80. As such, no additional detailed description is warranted, other than to identify the corresponding elements of the different embodiments.

In FIGS. 81, 82, and 84–86, a dual segment heart shaped base member 395 is illustrated, each segment having a hollow interior, a top 397 with heart shaped openings 398, sidewalls 399, windows 401 formed in the sidewalls 399, a support brace 407, and an insert support 409 with a hole 411 therein.

Figure 84:
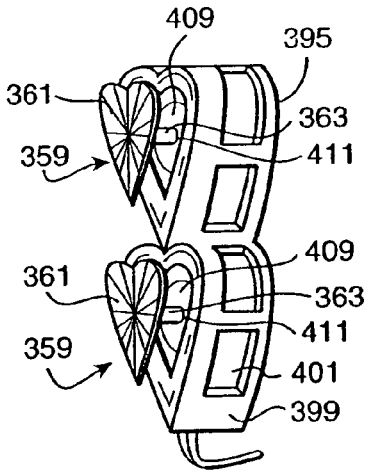
FIG. 84 is a view similar to that of FIG. 82, with a pair of decorative objects as shown in FIG. 75 being inserted through the top openings of the dual base member.
Figure 85:
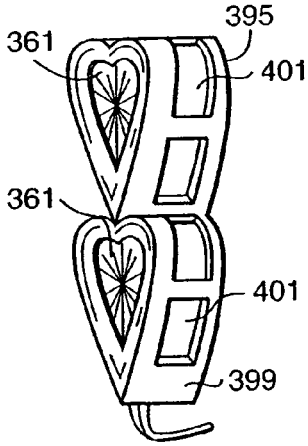
FIGS. 85 and 86 are side and front perspective views, respectively, of a fully assembled dual segment decorative jewelry item comprised of the base member as shown in FIGS. 81 and 82 and the decorative object shown in FIGS. 74 and 75.
Figure 86:
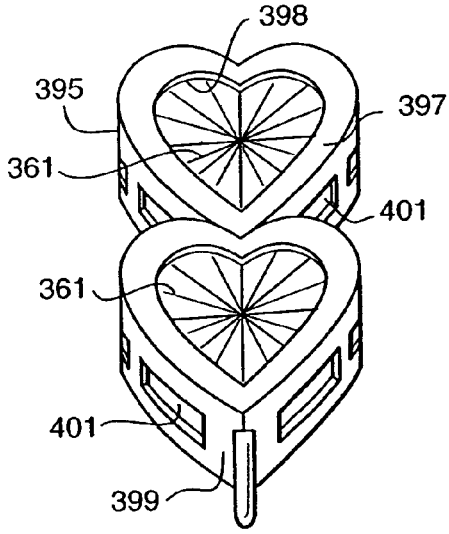

A pair of decorative objects 359, with their plate-shaped decorative inserts 361 and rear projecting pins 363, are shown just being inserted in insert supports 409 in FIG. 84. FIGS. 85 and 86 show, respectively, side and front perspective views of the completed dual segmented jewelry article.

In the manufacture of multiple segmented jewelry articles, precious metal and labor cost savings can be realized by providing a means to mount a multiple segmented decorative insert within a multiple segmented base member with a minimum amount of bonded contact and yet maintain a high degree of structural integrity. One example of this can be seen by reference to a representative embodiment shown in FIGS. 87–89.

Figure 87:
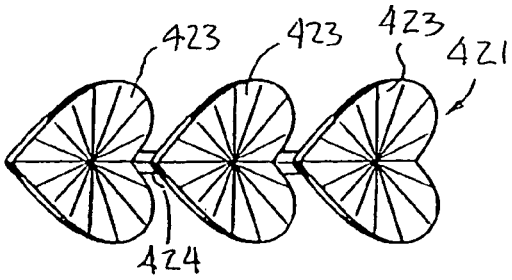
FIGS. 87 and 88 are top and side perspective views, respectively, of a multiple decorative insert.
Figure 88:
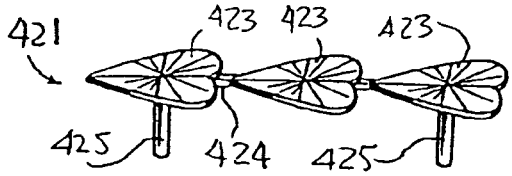

FIGS. 87 and 88 depict a multiple segmented decorative object 421 having multiple segmented plate-like inserts 423 connected together by integral bridging portions 424. As seen in FIG. 88, only the end inserts 423 have rear projecting pins 425.

Figure 89:
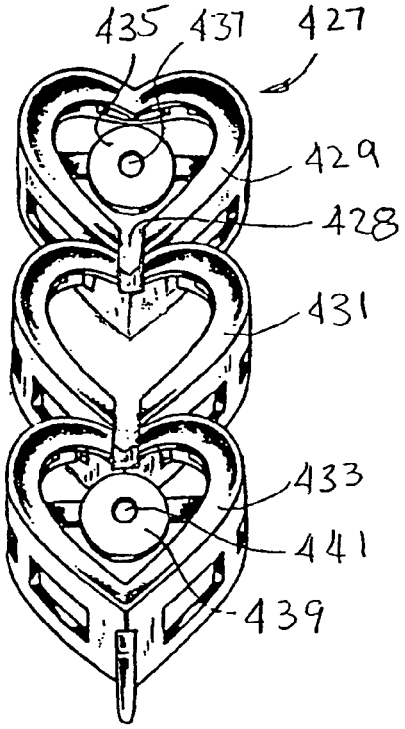
FIG. 89 is a front perspective view of a multiple segmented base member adapted to receive the multiple decorative insert of FIGS. 87 and 88.

FIG. 89 shows a corresponding multiple segmented base member 427 having base portions 429, 431, and 433. Base portions 429 and 433 each have an insert support 435 and 439, respectively, each insert support 435,439 having a hole 437,441 therein for accepting the rear projecting pins 425 of the multiple segmented decorative object 421. Channels 428 accept bridging portions 424 of a segmented decorative object 421. With this configuration, precious metal is saved by the elimination of a center insert support and center pin on decorative object 421, and the creation of channels 428. Manufacturing cost is also reduced due to the labor and materials saved by not having to fix a center pin of the center decorative insert 423 to an underlying insert support. Yet, the structural integrity of the jewelry article is obviously not adversely affected.

In this specification, where fixing or bonding is suggested, such fixing or bonding processing is intended to be selected from a number of available processes suitable for the task at hand including soldering, swaging, bending of prongs, applying of adhesive, and welding including laser welding, sonic welding, and other molecular bonding techniques.

Additionally, in this specification, where a decorative top, decorative object, decorative insert, or surface texturing or design are suggested, it is to be understood that such surface treatment may be selected from any of a large number of surface treatment processes, including diamond cutting, hole forming, embossing, engraving, lettering, forming line patterns, texturing, plating, coloring, etching, scoring, knurling, serrating, coating, painting, embossing, engraving, and shaping. In addition to having different surface treatments, the decorative object or insert may also be made of a different material than its base member or cap.

In like manner, the circular and heart shaped decorative objects and inserts shown and described herein are merely examples of an unlimited number of shapes and configurations, and the invention is not to be limited to the shapes and configurations depicted in the drawing and described herein.

For example, one interesting shape configuration for a decorative insert is that of a daisy flower with a center stem. In such an embodiment, the plate-shaped daisy flower insert may purposely be positioned spaced from the underlying insert support to simulate a flower at the end of a flower stem.

While FIGS. 60–64 and 72–88 show the decorative inserts being supported by a provided insert support member within the interior of the base member, it is equally preferred to have the decorative insert integrally formed with the formation of the base member, again diminishing labor costs. In one such embodiment, rather than referring to an opening in the top of the base member, it would be more accurate to refer to a recess in the top portion of the base member. That is, for the purposes of implementing the invention, the decorative insert support may be installed within the hollow base member or be made integrally with it, and where a top opening is mentioned in this text, it is to be interpreted as meaning either a top opening or a top recess.

It is to be understood that, while most of the embodiments of the present invention advantageously position the decorative object below the top surface of its base member, it is within the scope of the invention to have the depth of the recess or opening in the base member top to be slightly smaller or greater than the thickness of the decorative insert.

It is further to be understood that the number of connected modules to form a multiple-segment decorative jewelry item, and the geometrical arrangement of such connected modules, is virtually limitless. The specific arrangements shown and described herein are exemplary only.

In all embodiments and variations of the invention, the base members and caps do not necessarily have to be of the same type of material or color. For example, the base member can be silver, while the cap is yellow gold, or the base member and cap can be of different gold carat weights. Another example is a white gold base member with a pink gold cap. It is also within the scope of the present invention to make the base member of plastic or other hard material that is aesthetically pleasing to the eye.

While only certain embodiments of the invention have been set forth above, alternative embodiments and various modifications will be apparent from the above description and the accompanying drawing to those skilled in the art. For example, although specific examples are shown and described for convenience and ease of understanding, in variations of the invention, the base member or base member segments; the cap or cap segments, the openings in the cap or cap segments, the decorative objects, and the decorative inserts may, independently, be circular, square shaped, diamond shaped, heart shaped, and the like. Any combination of these and other geometric shapes are intended to be within the scope of the invention.

Likewise, it is contemplated that the designer may select for the base members, caps, objects, and inserts, surface features such as serrated surfaces, smooth surfaces, faceted surfaces, planar surfaces, convex surfaces, concave surfaces, conical surfaces, straight peripheral sides, stepped peripheral sides, as well as other shapes as described herein, including combinations of such features in a virtually limitless number of arrangements and presentations.

Additionally, although single and dual-segmented decorative jewelry items are shown and described in detail herein, any desired number of segments may be selected, the construction of which would be well within the skill of a person working in the jewelry art following the teaching in this description.

As described, the decorative object(s) and exposed surfaces of the stepped portion of the base units have preferred surface textures as shown and described. However, at the discretion of the designer, any or selected ones of such surfaces may be faceted, knurled, smooth, shiny, colored, frosted, or formed with diffraction gratings or filigree patterns, or may have thereon random markings, organized markings, and/or may be textured to simulate real gems.

In the preferred embodiments shown and described herein, the fastening means for fixing the cap to the base member, fixing a decorative object to the top surface of a base member, or maintaining a decorative insert within the hollow interior of a base member, may be implemented by methods such as soldering, swaging, scoring, adhesive bonding, and welding including laser welding. Swaging, scoring, and laser welding are techniques that work well with certain assembly process steps in accordance with the present invention, but are not suitable for fixing real gems in place due in large part to the configuration, shape, and weight of real gems. As to laser welding, reference is made to the apparatus and methods of laser welding techniques disclosed in California precision Products Co. Catalog "Laser Spot-Welding Systems", One Industrial Court, Riverside, R.I. 02915, U.S.A. Reference can be made to the document mentioned in the preceding sentence.

These and other alternatives and variations are considered equivalents and within the spirit and scope of the present invention.

The invention illustratively disclosed herein suitably may be practiced in the absence of any element which is not specifically disclosed herein.

The following claims are entitled to the broadest possible scope consistent with this application. The claims shall not necessarily be limited to the preferred embodiments or to the embodiments shown in the examples.

What is claimed is:

1. A method for constructing a decorative jewelry item, comprising:

providing a base member having a hollow interior, a top with an opening therein leading to said hollow interior, a bottom, and a sidewall extending from said top to said bottom;

providing a decorative insert smaller than said opening, said decorative insert for being inserted, through said opening, into said hollow interior and positioned entirely below said top, said decorative insert comprising a plate-shaped top and a rear projecting pin;

providing a support member fixed to the interior of said base member, said support member provided with a hole therethrough for receiving said pin;

placing said decorative insert into said hollow base member through said top opening and entirely positioned below said top, whereby said decorative insert is viewable through said top opening; and after placing said decorative insert, fixing said decorative insert to said support member within said base member, said fixing said decorative insert including fixing said pin to said support member by a process selected from the group consisting of applying an adhesive, soldering, welding including laser welding, molecular bonding, swaging, bending, and clamping, wherein:

said provided base member is segmented and has a multiple segmented hollow interior, a top with a multiple segmented opening therein leading to said hollow interior, a bottom, and a sidewall extending from said top to said bottom;

said provided decorative inset is a multiple segmented decorative insert configured and sized in relation to said multiple segmented top opening to be inserted, through said multiple segmented top opening, into said hollow interior and positioned below said top; and said fixing said decorative insert comprises inserting said multiple segmented decorative insert within said hollow interior with each segment of said multiple segmented decorative insert viewable through said top opening.

2. The method as claimed in claim 1, wherein:

said multiple segmented decorative insert has a plurality of said rear projecting pins, one of said pins located adjacent opposite edges of said multiple segmented decorative insert, such that at least one segment of said multiple segmented decorative insert does not have a rear projecting pin;

said segmented base member has a plurality of insert support members fixed to said base member interior for receiving corresponding ones of said plurality of rear projecting pins; and said fixing said decorative insert comprises fixing each pin to its corresponding insert support member.

* * * * *